US005997664A

United States Patent [19]

Tahara et al.

[11] Patent Number: 5,997,664

[45] Date of Patent: Dec. 7, 1999

[54] METHOD FOR PRODUCING GALVANIZED STEEL SHEET

[75] Inventors: Kenji Tahara; Junichi Inagaki, both of Fukuyama; Toyofumi Watanabe; Masaaki Yamashita, both of Yokohama, all of Japan

[73] Assignee: NKK Corporation, Tokyo, Japan

[21] Appl. No.: 08/870,244

[22] Filed: Jun. 6, 1997

Related U.S. Application Data

[62] Division of application No. 08/625,371, Apr. 1, 1996.

[51] Int. Cl.[6] ..... C21D 11/00

[52] U.S. Cl. ..... 148/504; 148/533; 148/602; 148/603

[58] Field of Search ..... 148/503, 504, 148/533, 601, 602, 603

[56] References Cited

U.S. PATENT DOCUMENTS

| | | | |
|---|---|---|---|
| 5,384,206 | 1/1995 | Ushioda et al. | 428/659 |
| 5,470,403 | 11/1995 | Yoshinaga et al. | 148/330 |

FOREIGN PATENT DOCUMENTS

| | | |
|---|---|---|
| 61-60860 | 3/1986 | Japan . |
| 61-291924 | 12/1986 | Japan . |
| 2-34722 | 2/1990 | Japan . |
| 2-38550 | 2/1990 | Japan . |
| 2-185949 | 7/1990 | Japan . |
| 4-52229 | 2/1992 | Japan . |
| 4080349 | 3/1992 | Japan . |
| 4-236751 | 8/1992 | Japan . |
| 4-263054 | 9/1992 | Japan . |
| 5-106003 | 4/1993 | Japan . |
| 406017142 | 1/1994 | Japan . |
| 406081043 | 3/1994 | Japan . |

*Primary Examiner*—Sikyin Ip

*Attorney, Agent, or Firm*—Frishauf, Holtz, Goodman, Langer & Chick, P.C.

[57] ABSTRACT

Method for producing a galvannealed steel sheet wherein a slab consisting essentially of C in an amount of 0.004 wt. % or less, N in an amount of 0.004 wt. % or less, Ti in an amount of 0.01 to 0.15 wt %, Si in an amount of 0.05 wt. % or less, Mn in an amount up to 2.5 wt. %, P in an amount up to 0.1 wt. %, S in an amount of 0.015 wt. % or less, sol. Al in an amount of 0.02 to 0.1 wt. % and the balance being Fe, is soaked for at least 30 minutes at a specified temperature (range). The soaked slab is hot rolled to produce a hot-rolled steel sheet which is coiled at a temperature of 500 to 700° C. The coiled hot-rolled steel sheet is cold rolled at a reduction ratio of 60% or more to produce a cold-rolled steel sheet which is annealed at a temperature of from recrystallization temperature to Ac3 transformation temperature. Galvanizing the annealed cold-rolled steel sheet and then galvannealing at a temperature of 450 to 600° C.

6 Claims, 7 Drawing Sheets

METHOD FOR PRODUCING GALVANIZED STEEL SHEET

This application is a divisional application of Ser. No. 08/625,371 filed Apr. 1, 1996.

BACKGROUND OF THE INVENTION

1. Field of the Invention

The present invention relates to a galvannealed steel sheet having excellent surface appearance and press formability and a method therefor.

2. Description of the Related Art

Recently, galvannealed steel sheets have been widely used to manufacture bodies of automobiles in order to improve the corrosion resistance. Since the galvannealed steel sheets have been used to manufacture also the outer body panel of automobiles in recent years, the quality of the surface appearance of the galvannealed steel sheet has been particularly required.

In view of reducing the weight of the car body, integral forming of car body parts and reduction in the thickness of the steel sheet have been required, steel sheets having further improved press formability is required more strongly than ever. Therefore, so called IF (Interstitial Free) steel sheets have been used, in which solute carbon and nitrogen are fixed as carbides or nitrides by titanium or the like.

It, however, has been known that use of the IF steel, having titanium added thereto (hereinafter called "Ti-IF steel"), as the substrate of the galvannealed steel sheet involves long streaky patterns (hereinafter called "streaky defect") peculiar to the Ti-added steel being generated, causing surface appearance to deteriorate excessively.

As disclosed in, for example, Japanese Patent Application Laid-Open No. 2-34722, use of the IF steel enables the press formability to be significantly improved as compared with that of conventional low-carbon aluminum-killed steel. Since the prior art is, however, established in order to improve only the press formability, no description has been made about the improvement in the surface appearance. Another prior art paid attention to the surface appearance of the Ti-IF steel is disclosed in Japanese Patent Application Laid-Open No. 2-38550. In view of the streaky defect being caused from an influence of fine crystal grains in the surface layer of the Ti-IF steel, as prevention of the streaky defect, there have been given a method for coarsening the surface crystal grains by pre-annealing or the like and another method for grinding the surface of a hot-rolled steel sheet or a cold-rolled steel sheet. In either case, the additinal step, however, is introduced to the ordinary process for manufacturing the galvannealed steel sheet and, therefore, there arises a problem in that the manufacturing cost becomes too large. Moreover, the method using the pre-annealing process causes the crystal grains to be coarsed deeply in the internal layers, thus resulting in that there will arise problems of deterioration in the workability and rough surface after press stamping. The method using the surface grinding process results in problems of worsening in the manufacturing plant environment due to the ground chips, yield declination and excessive deterioration in the productivity. Therefore, the foregoing method has a problem as a method of manufacturing a galvannealed steel sheet having excellent surface appearance. As a means for improving the strength of the IF steel, addition of solid-solution hardening elements, such as Si, Mn or P into the steel, has been usually employed, as disclosed in Japanese Patent Application Laid-Open No. 2-185949. In the case where the IF steel is strengthened by adding P thereto, long streaky patterns (hereinafter called the "streaky defect") frequently are formed in the rolling direction. The streaky defect sometimes inhibits application of the foregoing steel to the outer body panels of the automobile. Since the foregoing methods have been established to mainly strengthen the steel sheet and to improve the formability, no intention has been made to improve the surface appearance of the steel sheet.

In any event, the foregoing methods are unsatisfactory to improve both the press formability and surface appearance.

As described above, most of the conventional methods have been established to primarily improve the press formability without much attention paid to improvement in the surface appearance. Although there is a method for improving the surface appearance, the cost inevitably rises. Thus, there arises a problem in industrial production.

SUMMARY OF THE INVENTION

It is an object of the present invention to provide a galvannealed steel sheet having excellent surface appearance and press formability and a manufacturing method therefor.

To attain the object, the present invention provides a steel sheet suitable for galvannealing, the steel sheet consisting essentially of C in an amount of 0.004 wt % or less, N in an amount of 0.004 wt % or less, Ti in an amount of 0.01 to 0.15 wt % and the balance being Fe;

said steel sheet having ferrite crystal grains in the uppermost layer thereof;

the steel sheet having a mean ferrite grain size of $d_1$ at a point on the uppermost layer thereof, a mean ferrite grain size of $d_2$ at a point apart from the point for at least 10 mm on the uppermost layer, mean ferrite grain size ratio R ($=d_1/d_2$) which is a ratio of the mean ferrite grain size $d_1$ and the mean ferrite grain size $d_2$, and $R_{mean}$ which is a mean value of mean ferrite grain size ratios (R) on at least two points in the same width direction of the steel sheet; and said $R_{mean}$ being from 0.9 to 1.1.

The steel sheet can consist essentially of C in an amount of 0.004 wt % or less, N in an amount of 0.004 wt % or less, Ti in an amount of 0.01 to 0.15 wt %, Si in an amount of 0.05 wt % or less, Mn in an amount of 0.5 to 2.5 wt %, P in an amount of 0.02 to 0.1 wt %, S in an amount of 0.015 wt % or less, sol.Al in an amount of 0.02 to 0.1 wt % and the balance being Fe.

The steel sheet can consist essentially of C in an amount of 0.004 wt % or less, N in an amount of 0.004 wt % or less, Ti in an amount of 0.01 to 0.15 wt %, Si in an amount of 0.05 wt % or less, Mn in an amount of less than 0.5 wt %, P in an amount of less than 0.02 wt %, S in an amount of 0.015 wt % or less, sol.Al in an amount of 0.02 to 0.1 wt % and the balance being Fe.

A galvannealed steel sheet has a galvannealed coating layer formed on the above-mentioned steel sheet by galvannealing.

Secondly, the present invention further provides a steel sheet suitable for galvannealing, the steel sheet consisting essentially of C in an amount of 0.004 wt % or less, N in an amount of 0.004 wt % or less, Ti in an amount of 0.01 to 0.15 wt % and the balance being Fe;

said steel sheet having ferrite crystals in the uppermost layer thereof;

each of the ferrite crystals having a (200) plane and a (222) plane, and said (200) plane and said (222) plane having X-ray peak intensity ratios $I_{(200)}$ and $I_{(222)}$ respectively and a ratio $X=I_{(222)}/I_{(200)}$;

the steel sheet having $X_1$, which is a value of X at a first point on a surface of the steel sheet, $X_2$, which is a value of X at a second point apart from the first point for at least 10 mm and R ($=X_1/X_2$) which is a ratio of $X_1$ and $X_2$; and the steel sheet having $R_{mean}$ of 0.5 to 2, said $R_{mean}$ being a mean value of R at at least two points in the same widthwise direction of the steel sheet.

The steel sheet can consist essentially of C in an amount of 0.004 wt % or less, N in an amount of 0.004 wt % or less, Ti in an amount of 0.01 to 0.15 wt %, Si in an amount of 0.05 wt % or less, Mn in an amount of 0.5 to 2.5 wt %, P in an amount of 0.02 to 0.1 wt %, S in an amount of 0.015 wt % or less, sol.Al in an amount of 0.02 to 0.1 wt % and the balance being Fe.

The steel sheet can consist essentially of C in an amount of 0.004 wt % or less, N in an amount of 0.004 wt % or less, Ti in an amount of 0.01 to 0.15 wt %, Si in an amount of 0.05 wt % or less, Mn in an amount of less than 0.5 wt %, P in an amount of less than 0.02 wt %, S in an amount of 0.015 wt % or less, sol.Al in an amount of 0.02 to 0.1 wt % and the balance being Fe.

A galvannealed steel sheet has a galvannealed coating layer formed on the above-mentioned steel sheet by galvannealing.

Thirdly, the present invention further provides a method for producing a galvannealed steel sheet comprising the steps of:

(a) preparing a slab consisting essentially of C in an amount of 0.004 wt % or less, N in an amount of 0.004 wt % or less, Ti in an amount of 0.01 to 0.15 wt %, Si in an amount of 0.05 wt % or less, Mn in an amount of less than 0.5 wt %, P in an amount of less than 0.02 wt %, S in an amount of 0.015 wt % or less, sol.Al in an amount of 0.02 to 0.1 wt % and the balance being Fe;

(b) soaking the slab at a temperature (T° C.) defined by the following equation for at least 30 minutes:

$$-615[\%Ti]+1160 \leqq T \leqq -385[\%Ti]+1230;$$

(c) hot-rolling the soaked slab to produce a hot-rolled steel sheet and then coiling the hot-rolled steel sheet at a temperature of 500 to 700° C.;

(d) cold-rolling the coiled hot-rolled steel sheet at a reduction ratio of 60% or more to produce a cold-rolled steel sheet;

(e) annealing the cold-rolled steel sheet at a temperature of from recrystallization temperature to $Ac_3$ transformation temperature;

(f) galvanizing the annealed cold-rolled steel sheet; and (g) galvannealing the galvanized cold-rolled steel sheet at a temperature of 450 to 600° C.

Fourthly, the present invention further provides a method for producing a galvannealed steel sheet comprising the steps of:

(a) preparing a slab consisting essentially of C in an amount of 0.004 wt % or less, N in an amount of 0.004 wt % or less, Ti in an amount of 0.01 to 0.15 wt %, Si in an amount of 0.05 wt % or less, Mn in an amount of 0.5 to 2.5 wt %, P in an amount of 0.02 to 0.1 wt %, S in an amount of 0.015 wt % or less, sol.Al in an amount of 0.02 to 0.1 2() wt % and the balance being Fe;

(b) soaking the slab at a temperature (T° C.) defined by the following equation for at least 30 minutes:

$$1100 \leqq T \leqq ([\%Ti]+[\%P])+1250$$

(c) hot-rolling the soaked slab to produce a hot-rolled steel sheet and then coiling the hot-rolled steel sheet at a temperature of 500 to 700° C.;

(d) cold-rolling the coiled hot-rolled steel sheet at a reduction ratio of 60% or more to produce a cold-rolled steel sheet;

(e) annealing the cold-rolled steel sheet at a temperature of from recrystallization temperature to $Ac_3$ transformation temperature;

(f) galvanizing the annealed cold-rolled steel sheet; and (g) galvannealing the galvanized cold-rolled steel sheet at a temperature of 450 to 600° C.

Other objects, features and advantages of the invention will be evident from the following detailed description of the preferred embodiments described in conjunction with the attached drawings.

DESCRIPTION OF THE PREFERRED EMBODIMENTS

Figure 1:
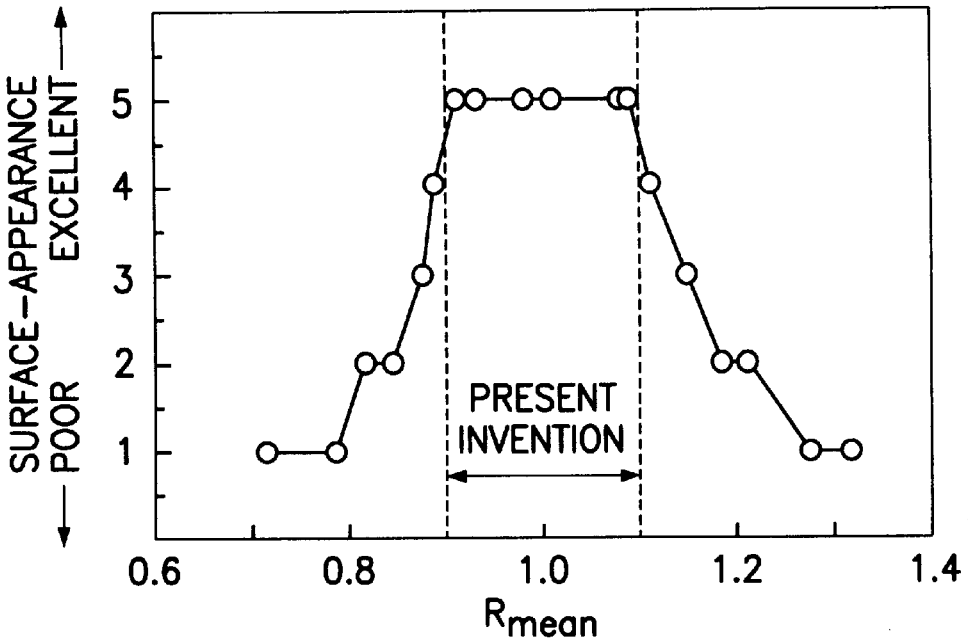
FIG. 1 is a graph showing the relationship between $R_{mean}$, which is a mean value of a mean ferrite grain size ratio (R), and the grade of surface appearance according to the present invention.

The inventors of the present invention have performed research and attained the following knowledge:

(1) Important is a size distribution of ferrite grains in the uppermost layer of the substrate steel sheet after annealing and before galvanizing to obtain a galvannealed steel sheet having good press formability and excellent surface appearance.

That is, the coating layer of the steel sheet having the streaky defects was dissolved and removed with dilute hydrochloric acid to inspect the distribution of ferrite grains from the surface of the steel sheet. As the result of inspection, the following was found.

(a) The mean size of crystal grains in the surface of the steel sheet just below the portion having the streaky defect is larger than that in the normal portions.

(b) The smaller the difference in the mean grain size of the ferrite between the normal portions and the portion having the streaky defect, the less inconspicuous the streaky defect becomes.

From the foregoing, the inventors learned that the distribution of the grain size of ferrite in the surface layer of the substrate steel sheet is not uniform and that regions having large crystal grains exist in the streaky shapes. Thus, the alloying rate is reduced as compared with that in the normal portions and, thus, the finally obtained coating layer has different surface shapes. As a result, the streaky defect takes place.

In accordance with the foregoing findings, one aspect of the present invention is as follows:

A steel sheet suitable for galvannealing, the steel sheet consisting essentially of C in an amount of 0.004 wt % or less, N in an amount of 0.004 wt % or less, Ti in an amount of 0.01 to 0.15 wt % and the balance being Fe, wherein the ratio of mean ferrite grain size $d_1$ in the uppermost layer at a certain point on the steel sheet and mean ferrite grain size $d_2$ in the uppermost layer at a point apart from the foregoing point for at least 10 mm is defined to be R ($=d_1/d_2$) and mean value $R_{mean}$ of R of at least two points in the same widthwise direction of the steel sheet is from 0.9 to 1.1.

The foregoing steel sheet can further contain 0.05 wt % or less Si, 0.5 to 2.5 wt % Mn, 0.02 to 0.1 wt % P, 0.015 wt % or less S and 0.02 to 0.1 wt % sol.Al. Also, the steel sheet can further contain 0.05 wt % or less Si, less than 0.5 wt % Mn, less than 0.02 wt % P, 0.015 wt % or less S and 0.02 to 0.1 wt % sol.Al. The steel sheet can further contain 0.001 to 0.020 wt % Nb. The steel sheet can further contain 0.0001 to 0.0020 wt % B. Each of the foregoing steel sheets is galvanizing after annealing, and then galvannealed to produce a galvannealed steel sheet. Forming of a galvanized coating layer, such as a Fe—Zn coating layer containing 50 wt. % or more Fe, on the surface of the obtained galvannealed steel sheet will attain further improved press formability.

(2) Moreover, the inventors found that it is important to control texture in the uppermost layer of the substrate steel sheet subjected to the annealing process in order to obtain a galvannealed steel sheet excellent in surface appearance. That is, the coating layer of the steel sheet which has produced the streaky defect is dissolved and removed by diluted hydrochloric acid to measure the texture of crystal grains immediately below the coating layer by X-ray diffraction. As a result, there is found the difference in the texture in the uppermost layer of the steel sheet between the normal portions and the streaky defect portions. In particular, it is found conspicuous streaky defect takes place in proportion to the difference in the diffractive intensity between plane (222) and plane (200). If the texture of ferrite in the uppermost layer of the substrate steel sheet are non-uniform in the width direction of the steel sheet, the difference in the alloying rate on ferrite crystal grains is made and a streaky defect, which can be recognized totally, takes place. As a result, it is important for the improvement in the surface appearance to make uniform the texture in the surface layer of the substrate steel sheet.

In accordance with the foregoing finding, further aspects of the present invention are established as follows:

There is provided a galvannealed steel sheet having excellent surface appearance and press formability and consisting essentially of 0.004 wt % or less C, 0.004 wt % or less N and 0.01 to 0.15 wt % Ti, wherein when X-ray peak intensity ratios ($I/I_0$) of planes (200) and (222) of ferrite in the uppermost layer of the steel sheet are defined to be $I_{(200)}$ and $I_{(222)}$, their ratio is defined to be $x=I_{(222)}/I_{(200)}$ and the ratio of the value of x ($x_1$) at a certain point on the steel sheet and the value of x ($x_2$) at a point apart from the foregoing point for at least 10 mm in the width direction of the steel sheet is defined to be R ($=x_1/x_2$), mean value $R_{mean}$ of R at two or more positions in the same width direction is from 0.5 to 2.0.

The foregoing steel sheet can further contain 0.05 wt % or less Si, 0.5 to 2.5 wt % Mn, 0.02 to 0.1 wt % P, 0.015 wt % or less S and 0.02 to 0.1 wt % sol. Al. The steel sheet can further contain 0.05 wt % or less Si, less than 0.5 wt % Mn, less than 0.02 wt % P, 0.015 wt % or less S and 0.02 to 0.1 wt % sol. Al. The steel sheet can further contain 0.001 to 0.020 wt % Nb. The steel sheet can further contain 0.0001 to 0.0020 wt % B. Each of the foregoing steel sheets is galvanized after annealing, and then galvannealed to produce a galvannealed steel sheet. Forming of a coating layer, such as a Fe—Zn coating layer containing 50 wt. % or more Fe, on the surface of the obtained galvannealed steel sheet will attain further improved press formability.

(3) Moreover, the inventors examined the cause of the non-uniformity in the ferrite grain size distribution and the texture in the substrate steel sheet subjected to annealing and obtained the following knowledge. That is, in the Ti-IF steel, Ti in the Ti-IF steel is combined with C, S, N and P. Thus, precipitates TiC, $Ti_4C_2S_2$, TiS, TiN, FeTiP and the like are formed. The precipitates are formed during slab casting. However, the quantities and sizes of the precipitates involve a local scatter which is attributable to the cast structures. During slab heating, the precipitates are re-dissolved and/or coarsed, thus causing the local scatter to be further remarkable. The non-uniform re-dissolution and re-precipitation of the precipitates induces the shapes (sizes) of the precipitates to be to different from one another locally. As a result, it has been found that the growth rate of the ferrite grains is made to be different, thus causing the recrystallized grain size and the crystal orientation distribution after cold rolling and annealing to become irregular.

Since a Ti-IF steel in general has the grain boundary having superior cleanness to that of low-carbon aluminum-killed steel, rapid Fe—Zn reactions, called "outburst reaction" can easily occur at the grain boundary during alloying. Thus, the alloying rate is determined depending upon the foregoing reactions. The inventors found that the outburst reactions do not simultaneously occur in all grain boundaries but can easily take place on the (100) plane and grain boundaries in the vicinity of crystals having the orientation approximating that of the (100) plane. If the size or the orientation of the crystals, existing in the uppermost layer of the steel sheet after the recrystallization and annealing, encounters an irregularity, the alloying reactions cannot be performed uniformly. Therefore, the alloying rate can be made different locally, thus resulting in the locally remaining irregular degree of alloying being recognized as the streaky defect. As a result of the investigation above, the inventors found that the generation of irregularity above can be prevented by making uniform the form (size) of precipitates in the steel sheet. Also they found that for the realization, there are an appropriate range of temperatures for slab heating and the appropriate temperature range is different depending upon the addition amount of Ti or those of Ti and P.

In accordance with the foregoing knowledge, a still further aspect of the present invention is established as follows:

There is provided a method for producing a galvannealed steel sheet having excellent surface appearance and press formability, the method comprising the steps of: soaking, at temperature (T) defined by the following equation for 30 minutes or more, a slab consisting essentially of 0.004 wt % or less C, 0.004 wt % or less N, 0.01 to 0.15 wt % Ti, 0.05 wt % or less Si, less than 0.5 wt % Mn, less than 0.02 wt % P, 0.015 wt % or less S and 0.02 to 0.1 wt % sol. Al; hot-rolling the soaked slab to produce a hot-rolled steel sheet and then coiling the hot-rolled steel sheet at a temperature of 500 to 700° C.; cold-rolling the coiled hot-rolled steel sheet at a reduction ratio of 60% or more to produce a cold-rolled steel sheet; annealing the cold-rolled steel sheet at a temperature of from recrystallization temperature to Ac3 transformation temperature; galvanizing the annealed cold-rolled steel sheet; and galvannealing the galvanized cold-rolled steel sheet at a temperature of 450 to 600° C.:

$$-615[\%Ti]+1160 \leqq T \leqq -385[\%Ti]+1230 \quad \text{(A)}$$

Further, instead of the foregoing, there is provided a method of producing a galvannealed steel sheet having excellent surface appearance and press formability, the method comprising the steps of: soaking, at a temperature (T) of from 1100° C. to {−400 ([%Ti]+[%P])+1250° C.} for 30 minutes or more, a slab consisting essentially of 0.004 wt % or less C, 0.05 wt % or less Si, 0.5 to 2.5 wt % Mn, 0.02 to 0.1 wt % P, 0.015 wt % or less S, 0.02 to 0.1 wt % sol. Al, 0.0040 wt % or less N and 0.01 to 0.15 wt % Ti; hot-rolling the soaked slab to produce a hot-rolled steel sheet and then coiling the hot-rolled steel sheet at a temperature of 500 to 700° C.; cold-rolling the coiled hot-rolled steel sheet at a reduction ratio of 60% or more to produce a cold-rolled steel sheet; annealing the cold-rolled steel sheet at a temperature of from recrystallization temperature to Ac3 transformation temperature; galvanizing the annealed cold-rolled steel sheet; and galvannealing the galvanized cold-rolled steel sheet at a temperature of 450 to 600° C.

The slab can further contains 0.001 wt % to 0.020 wt % of Nb or 0.0001 wt % to 0.0020 wt % of B. The foregoing steel sheet is, after annealing, galvanized and then galvannealed to produce a galvannealed steel sheet. Forming of a coating layer, such as a Fe—Zn coating layer containing 50 wt % or more Fe, on the surface of the obtained galvannealed steel sheet will attain further improved press formability.

(1) Reasons for limitation of steel composition of the steel is

C: Although it is preferable that the content of carbon be small to realize a large r-value, the upper limit of the content is determined to be 0.004 wt. % to attain the practical effect of the present invention.

N: Although it is preferable that the content of nitrogen be small to achieve a large r-value, the upper limit of the content is determined to be 0.004 wt. % to attain the practical effect of the present invention.

Ti: Titanium is added to fix solid solution carbon and nitrogen in the steel so as to obtain a large r-value. If the content of titanium is too large, the object of the present invention to prevent generation of the streaky defect cannot easily be achieved. The content of titanium is determined in view that if the content is less than 0.01 wt. %, then the effect of obtaining a large r-value cannot be obtained, and that if the content is larger than 0.15 wt. %, not only the foregoing effect cannot be improved but also the prevention of the streaky defect encounters a difficulty. Therefore, a preferred titanium content range is 0.01 to 0.15 wt. %.

In a case of high press formability, it is preferable that the range of addition of titanium be limited to $$Ti^*/C(\text{atomic ratio}) \geqq 4$$

where $Ti^*=Ti=(48/32)S-(48/14)N$

Nb: Also Nb is effective to prevent the streaky defect. The reason is that addition of Nb in a small quantity results in NbC being formed in the steel and the formed NbC being then again solid-dissolved in the ferrite when annealing is performed. As a result, a portion of carbon segregates into the ferrite grain boundaries and, thus, the outburst reactions in the grain boundary are inhibited. If the content is less than 0.001 wt. %, the desired effect cannot be obtained. If the content is more than 0.020 wt. %, the effect is saturated but the formability of the steel sheet is deteriorated. Thus, the content is determined as described above.

Si: Si is an effective element to serve as a reinforcing element capable of improving the yield strength and the tensile strength. If the content is more than 0.05 wt. %, the r-value of the steel sheet is deteriorated. What is worse, streaky defects take place due to Si in the steel when annealing is performed, resulting in the surface appearance becoming deteriorated. Therefore, the content is determined to be 0.05% or less.

Mn: Similarly to Si, Mn is effective to reinforce the steel sheet. If the content is too large, the r-value of the steel sheet is deteriorated. Therefore, the content of Mn is determined to be 2.5% or less. It is preferable that the content be less than 0.5% for soft steel of a type which must have excellent deep drawability. The content may be 0.5% to 2.5% for steel having high strength which must be both excellent deep drawability and improved strength.

P: P is an element capable of reinforcing the steel with the lowest cost. If the content is too large, the alloying reactions are inhibited, irregularity takes place during alloying and the surface appearance is deteriorated. Therefore, the content is determined to be 0.1% or less.

As described hereinafter, it is preferable that control of the temperature for soaking be varied depending upon the contents of Mn and P. That is, if less than 0.5 wt. % of Mn and less than 0.02 wt. % P are contained, the temperature range for soaking is determined to correspond to the content of Ti. If the content of Mn is 0.5 wt. % to 2.5 wt. % and that of P is 0.02 wt. % to 0.1 wt. %, it is preferable that the temperature for soaking be determined to correspond to the contents of Ti and P.

S: Since S causes the ductility of the steel sheet to deteriorate, it is preferable that the content be minimized. To achieve the practical effect of the present invention, the upper limit is determined to be 0.015 wt. %.

sol. Al: Aluminum content is required to be 0.02 wt. % or more for deoxidation. If the quantity is too large, the cost cannot be reduced. Therefore, the upper limit is determined to be 0.10 wt. %.

B: B is an important element to be added in the present invention. That is, addition of B results in the reactivity in the ferrite crystal grain boundary being allowed to deteriorate and, therefore, the outburst reactions being inhibited and thus the streaky defect being prevented. If the streaky defect cannot be prevented by controlling the grain size distribution or by controlling the texture in the surface layer, addition of B will prevent the streaky defect. If the content is less than 0.0001 wt. %, the foregoing effect cannot be obtained. If the content is more than 0.0020%, the formability of the steel sheet remarkably deteriorates. Because of the foregoing reasons, the content is determined to be in the foregoing range.

(2) Reason for limitation of the crystal size

In the present invention, the ratio of the crystal grain sizes is determined as a result of the following experiments.

Steel sample shown in Tables 1 and 2 were heated at 1150 to 1250° C., and then the samples were hot-rolled so that the thickness of each sample was reduced to 3.2 mm, followed by being coiled at 550 to 700° C. The samples were acid-pickled, and then cold-rolled to have a thickness of 0.7 mm, and then continuously annealed at 800 to 880° C. Then, the samples were galvanized in a coating weight of 60 g/m$^2$ per surface, and then the samples were galvannealed at 460 to 550° C. Each of the obtained steel sheets was subjected to a temper rolling with a reduction ratio of 0.7% to obtain steel samples. The surface appearance of the obtained steel sheet was evaluated by five grades such as the best (no streaky defect observed) was given by 5 points and the worst (unsatisfactory streaky defect observed) by 1 point. Moreover, normal galvannealed portions and defective galvannealed portions, which could be determined by visual inspection from the surface appearance, were processed by dissolving and removing the coating layer thereon with a water solution of 5% HCl to observe ferrite grains in the surface layer of the steel sheet just therebelow and the mean grain sizes were observed. The method of measuring the mean grain size was performed in accordance with the cutting method regulated in JIS G0552 such that the grain size number was converted into the mean grain size. Moreover, the mean grain size in the uppermost layer in the normal portions was made to be $d_1$ and the mean grain size in the uppermost layer in the streaky defect portions was made to be $d_2$ when R was obtained. When no streaky defect took place, a convenient method was employed in which $d_1$ in the lengthwise central portion of the coil and in the central portion of the widthwise direction of the same and $d_2$ at a point apart from $d_1$ for 30 mm to the right in the forward direction of the line were measured to obtain $R_1$. Moreover, in the same widthwise direction as the widthwise direction in which $R_1$ was measured, d at a point, for mm, apart from the portion, in which the samples, $d_2$ of which were measured were taken, to the right in the forward direction of the line and d at a point, for 30 mm, apart from the foregoing point to the right in the forward direction of the line were measured so that $R_2$ was obtained. The foregoing operations were repeated seven times to the right in the forward direction of the line so that mean R value ($R_{mean}$) was obtained from all of the R values.

Figure 2:
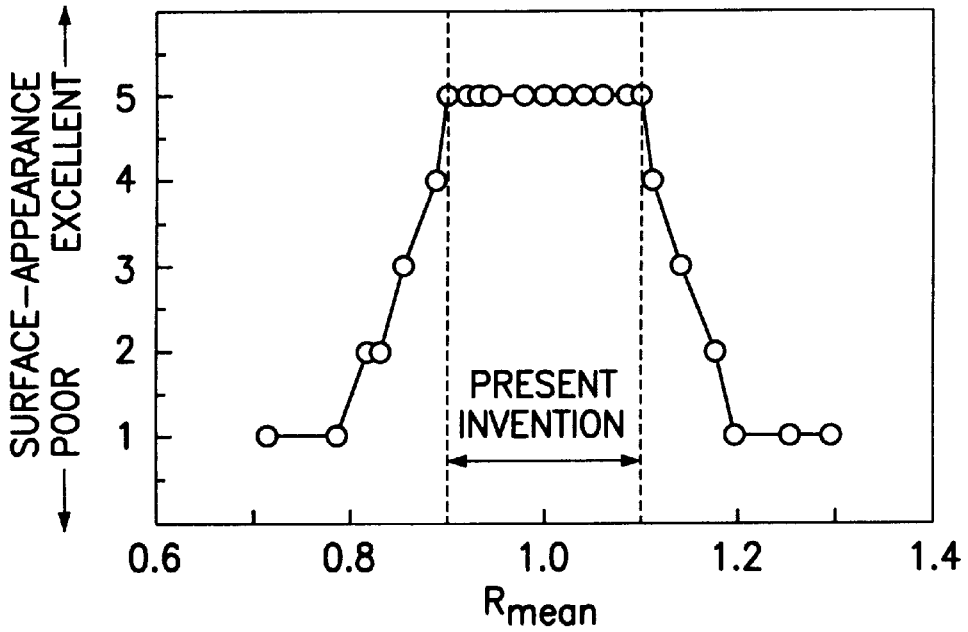
FIG. 2 is another graph showing the relationship between $R_{mean}$, which is the mean value of the mean ferrite grain size ratio (R), and the grade of the surface appearance according to the present invention.

The grades of the surface appearance were evaluated by $R_{mean}$, thus resulting in values shown in FIG. 1 (in the case of the composition of the steel shown in Table 1) and FIG. 2 (in the case of the composition of the steel shown in Table 2). In either case, a galvannealed steel sheet was obtained when $R_{mean}$ was in a range from 0.9 to 1.1.

The inventors examined a variety of steel samples in addition to the steel samples shown in Tables 1 and 2, thus resulting in that excellent surface appearance can be realized if $R_{mean}$ is in the range from 0.9 to 1.1 in the case of the range of the composition of the steel according to the present invention. Therefore, the grain size ratio $R_{mean}$ was limited to the range from 0.9 to 1.1.

TABLE 1

| C | Si | Mn | P | S | sol. Al | N | Ti |
|---|---|---|---|---|---|---|---|
| 0.0022 | 0.02 | 0.18 | 0.009 | 0.007 | 0.055 | 0.0025 | 0.063 (wt %) |

TABLE 2

| C | Si | Mn | P | S | sol. Al | N | Ti |
|---|---|---|---|---|---|---|---|
| 0.0022 | 0.02 | 0.65 | 0.043 | 0.009 | 0.063 | 0.0021 | 0.078 (wt %) |

(3) Reason for determination of the texture

In the present invention, the texture in the uppermost layer of the substrate steel sheet was limited as described above as a result hi of the following experiments and the like.

The steel samples having the compositions shown in Tables 1 and 2 were heated to 1150 to 1250° C., and then hot-rolled to reduce the thickness to 3.2 ml, followed by being coiled into coils at 550 to 700° C. The samples were acid-pickled, and then cold-rolled to have a thickness of 0.7 mm, and then continuously annealed at 800 to 880° C.

Then, the samples were galvanized in a coating weight of 60 g/m$^2$ per surface, and then the samples were galvannealed at 460 to 550° C. Each of the obtained steel sheets was temper-rolled with a reduction ratio of 0.7% to produce a steel sheet product. The surface appearance of the obtained steel sheet was evaluated by five grades such as the best (no streaky defect observed) was given by 5 points and the worst (streaky defect remarkably observed) was given by 1 point. Moreover, normal galvannealed portions and defective galvannealed portions, which could be determined visually from the appearance, were processed by measuring X-ray diffractive intensity of the portions of the base steel sheet just below the coating layer in the normal and streaky defect portions. When no streaky defect took place, a convenient method was employed in which $x_1$ in the lengthwise central portion of the coil and in the central portion of the widthwise direction of the same and $x_2$ at a point apart from the foregoing point for 40 mm to the right in the forward direction of the line were measured to obtain $R_1$. Moreover, in the same widthwise direction as the widthwise direction in which. $R_1$ was measured, x at a point, for 40 mm, apart from the portion, in which the samples, $x_2$ of which were measured were taken, to the right in the forward direction of the line and x at a point, for 40 mm, apart from the foregoing point to the right in the forward direction of the line were measured so that $R_2$ was obtained. The foregoing operations were repeated seven times to the right in the forward direction of the line so that mean R value ($R_{mean}$) was obtained from all of the R values. The samples subjected to the X-ray diffraction had a diameter of 28 mm. The coating layer of each sample was separated by diluted hydrochloric acid before the X-ray diffraction was performed.

Figure 3:
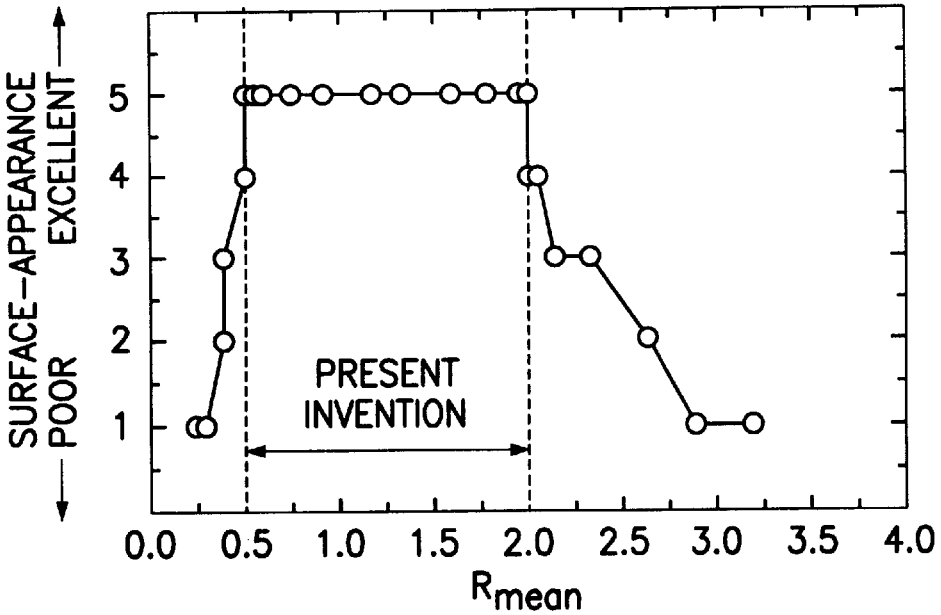
FIG. 3 is a graph showing the relationship between $R_{mean}$, which is a mean value of an X-ray intensity ratio (R) and the grade of the surface appearance according to the present invention.
Figure 4:
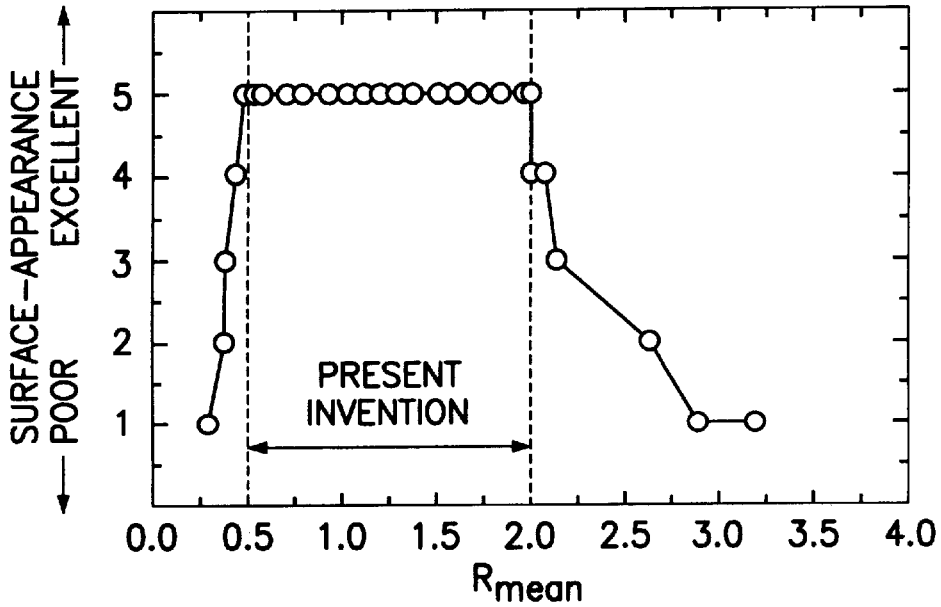
FIG. 4 is another graph showing the relationship between $R_{mean}$, which is the mean value of the X-ray intensity ratio (R) and the grade of the surface appearance according to the present invention.

The results were shown in FIGS. 3 and 4. When the values of a were in a range from 0.5 to 2.0, galvannealed steel sheets having excellent surface appearance were obtained.

In the present invention, the X-ray diffraction intensity was a value measured by using a Mo tube under conditions that the applied voltage was 40 kV and an electric current was 30 mA. Moreover, $I_{(222)}$ and $I_{(200)}$ were defined as follows:

$$I_{(hkl)}=[I_{(hkl)m}.I_B]]/I_{(hkl)S}$$

$I_{(hkl)m}$: intensity counted on plane (hkl)

$I_B$: background intensity $I_{(hkl)S}$: integrated intensity on plane (hkl) of standard sample of reduced Fe The inventors investigated a variety of steel samples in addition to the steel samples shown in Tables 1 and 2. As a result, excellent steel sheets having excellent surface appearance were able to be manufactured without the streaky defect if $R_{mean}$ is in the range from 0.5 to 2.0 in the case where the composition of the steel sheet was included in the range according to the present invention. According to the present invention, the control of the texture in the surface layer as described above does not cause the press formability to deteriorate because the texture in the direction of the width of the steel sheet can be maintained to be the same as those of the conventional steel sheet. Therefore, the present invention enables a galvannealed steel sheet having excellent surface appearance and press formability to be manufactured.

(4) Reason for determination of manufacturing method (4.1) Control of temperature depending upon Ti content (in case of P content being less than 0.02 wt. %)

Figure 5:
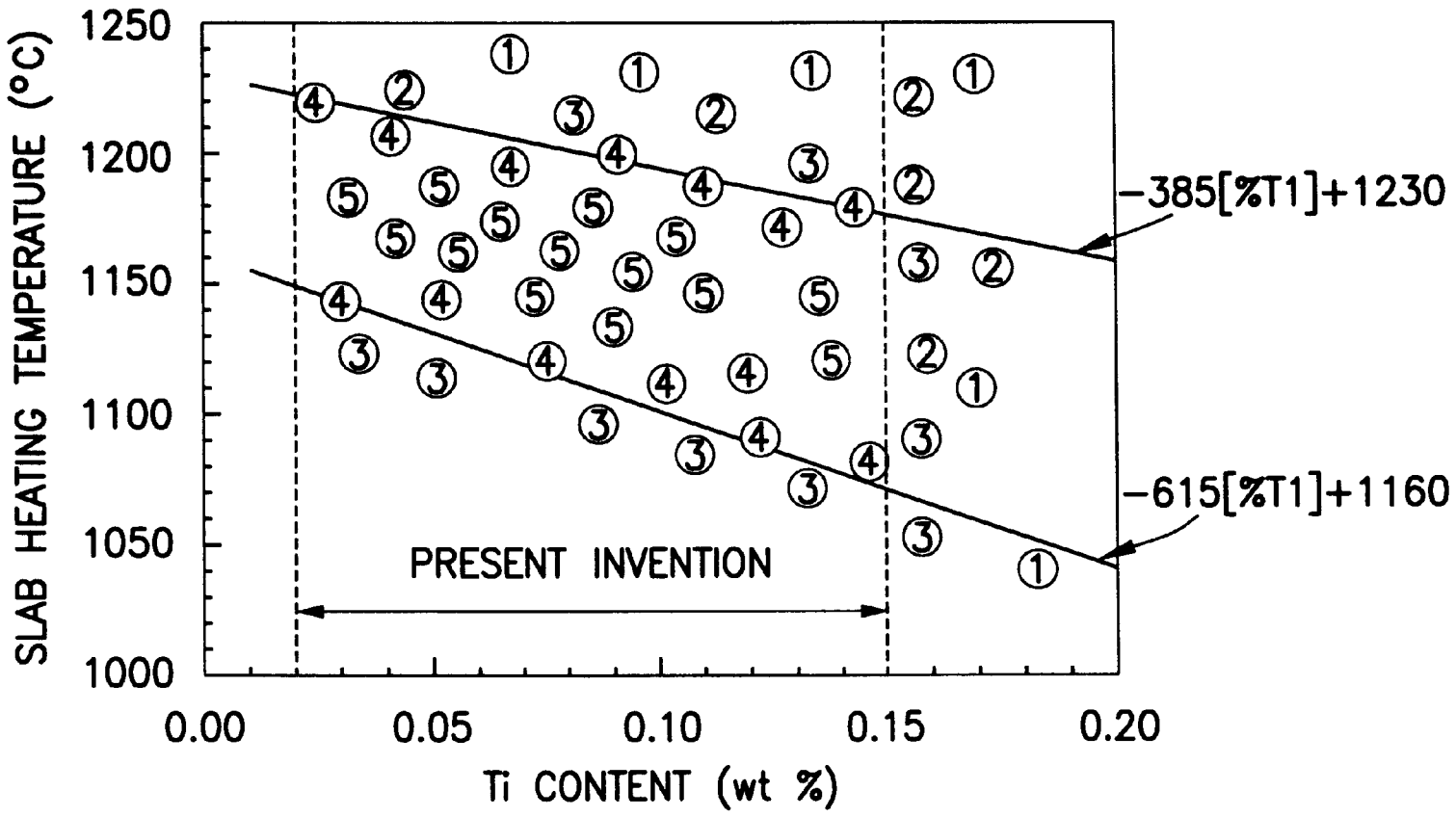
FIG. 5 is a graph showing influences of the content of Ti and temperature, at which a slab is heated, on the surface appearance according to the present invention.

Steel samples having compositions shown in Table 3 were melted to be formed into slabs, and then soaked at 1050 to 1300° C. for 60 minutes. Then, the slabs were hot-rolled to each have a thickness of 3.2 mm and then coiled into coils at 640° C. The obtained hot-rolled sheets were acid-pickled and then cold-rolled to have a thickness of 0.8 mm, followed by being continuously annealed at temperature of 830° C. Then, the samples were galvanized in a coating weight of 60 g/m$^2$ per surface, and then immediately galvannealed as an alloying treatment at temperature of 510° C., and then temper-rolled with a reduction ratio of 0.7%. The surface appearance characteristics of the obtained products were evaluated by five grades (from worst given 1 point to best given 5 points). The results were shown in FIG. 5. Products having mark four or better can be obtained if the temperature at which the slabs are heated, is appropriate. This can be expressed by the following regression equation:

$$-615[\%Ti]+1160 \leqq T \leqq -385[\%Ti]+1230 \quad (A)$$

The inventors gave steel samples having a variety of compositions in similar experiments and found that the regression equation can be satisfied if the steel has the composition within the range of the present invention.

As described above, the samples are soaked at a temperature defined by Equation (A) for 30 minutes or more. The reason why the slab is soaked for 30 minutes or more is that the precipitates formed at slab casting are caused to sufficiently grow so as to make the structure uniform. If the time is less than 30 minutes, the precipitates cannot sufficiently be precipitated. The time, in which the slab is soaked, is substantially the same as the slab holding time in a soaking furnace or a soaking zone. After the slab has been heated, the slab is hot-rolled. Although the finishing temperature is not specifically limited, it is preferable that the temperature be $Ar_3$ transformation temperature or more. If certain conditions are met, for example, if hot lubrication is performed sufficiently, the temperature is not limited to the foregoing level. After the hot rolling has been performed, the steel is coiled into a coil at a temperature in a range from 500 to 700° C. If the temperature is less than 500° C., the press formability deteriorates. If the temperature is more than 700° C., the press formability deteriorates similarly and the descalability deteriorates, thus causing the surface defects. Thus, the temperature is defined as described above. After hot rolling has been performed, the samples are acid-pickled by a usual method and then cold-rolled at a reduction ratio of 60% or more. The reason is that if the reduction ratio is less than 60%, satisfactory press formability cannot be obtained. Although the upper limit for the reduction ratio in performing the cold rolling is not specifically limited, it is preferable that the ratio be less than 90%, taking into consideration of load being applied to the rolling mill. After cold rolling, annealing for recrystallization is performed at preferred level of less than $AC_3$ transformation temperature. If the annealing is performed at a level of more than the $AC_3$ transformation temperature, the press formability are remarkably deteriorated. After the annealing, the samples are galvanized by a usual method, and then the coating weight is adjusted.

Then, the galvannealing as alloying treatment is performed. It is preferable that the galvannealing temperature (alloying temperature) be 450 to 600° C. If the temperature is less than 450° C. the alloying rate is too low and, therefore, the productivity deteriorates remarkably. What is worse, the streaky defect becomes conspicuous. If the temperature is more than 600° C., excess alloying takes place, anti-powdering property deteriorates and the streaky defect becomes conspicuous. After the galvannealing has been performed, temper rolling may be performed if necessary. In this case, the reduction ratio is in a range from 0.3 to 2%. If the product is required to have further improved press formability, a Fe—Zn alloy having a Fe content of 50 wt. % or more can be electroplated to the surface of the coating layer.

TABLE 3

| C | Si | Mn | P | S | sol. Al | N | Ti |
|---|---|---|---|---|---|---|---|
| 0.0015 to 0.0025 | 0.01 to 0.04 | 0.15 to 0.31 | 0.012 to 0.015 | 0.005 to 0.012 | 0.04 to 0.06 | 0.0019 to 0.0025 | 0.012 to 0.182 (wt %) |

(4.2) Control of temperature depending upon Ti and P contents (in the case of the P content being 0.02 to 0.100 wt. %)

Figure 6:
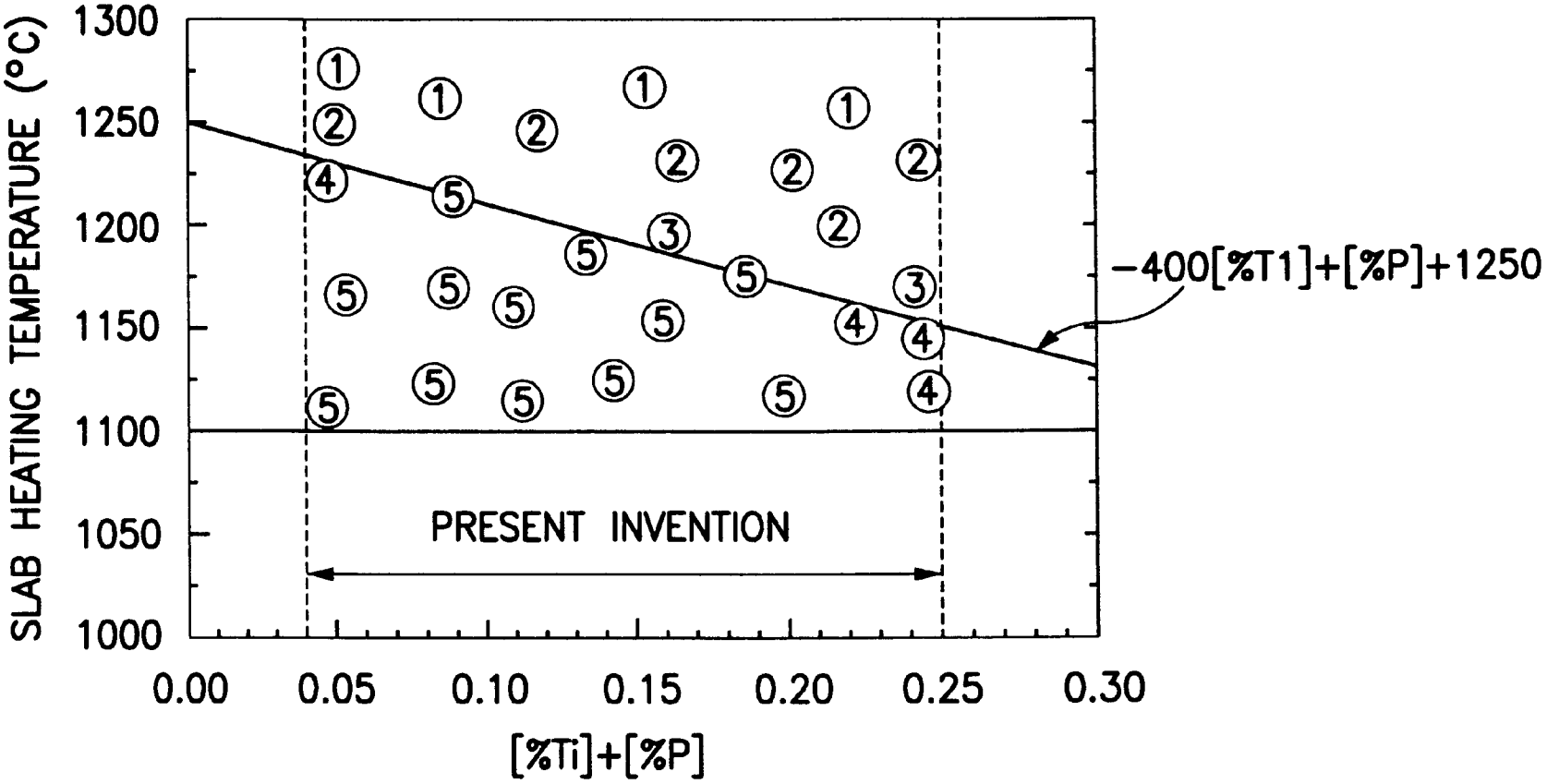
FIG. 6 is another graph showing the influences of the content of Ti and the temperature, at which the slab is heated, on the surface appearance according to the present invention.

Steel samples having compositions shown in Table 4 were melted to be formed into slabs, and then heated at 1100 to 1300° C. Then, the slabs were hot-rolled to each have a thickness of 3.2 mm and then formed into coils at 640° C. The obtained hot-rolled sheets were acid-pickled and then cold-rolled to have a thickness of 0.8 mm, followed by being continuously annealed at temperature of 830° C. Then, the samples were galvanized in a coating weight of 60 g/m$^2$ per surface, and then immediately galvannealed at temperature of 510° C., and then temper rolled with a reduction ratio of 0.7%. The surface appearance characteristics of the obtained products were evaluated by five grades from worst given by 1 point to best by 5 point. The results are shown in FIG. 6. Products having marks of four or better can be obtained if the temperature at which the slabs are heated, is appropriate. Moreover, the appropriate temperature changes depending upon the content of Ti and P in the steel. This can be expressed by the following regression equation:

$$-400([\%Ti]+[\%P])+1250 \quad (B)$$

If the slabs are heated at a temperature of less than 1100° C., the load applied during rolling is too heavy for the rolling mill. Therefore, the lower limit of the temperature was determined to be 1100° C.

The inventors gave steel samples having a variety of compositions in similar experiments and found that the regression equation can be satisfied if the steel had the composition within the range of the present invention. The reason why the upper limit temperature, at which the slab is heated, is changed due to addition of P is considered that P exists as precipitates in the form of FeTiP and the like, thus causing the forms of Ti precipitates to be changed.

As described above, the samples are soaked at a temperature defined by Equation (B) for 30 minutes or more. The reason why the slab is soaked for 30 minutes or more is that the precipitates formed at slab casting are caused to sufficiently grow so as to make the structure uniform. If the time is less than 30 minutes, precipitates cannot sufficiently be precipitated. The time, in which the slab is soaked, is substantially the same as the slab holding time in a soaking furnace or a soaking zone. After the slab has been heated, the slab is hot-rolled. Although the finishing temperature is not specifically limited, it is preferable that the temperature be $Ar_3$ transformation temperature or more. If certain conditions are met, for example, if hot lubrication is performed sufficiently, the temperature is not limited to the foregoing level. After hot rolling, the steel is coiled into a coil at a temperature in a range from 500 to 700° C. If the temperature is less than 500° C., the press formability deteriorates. If the temperature is 700° C. or more, the press formability deteriorates similarly and the descalability deteriorates, thus causing the surface defect. As a result, the temperature is determined as described above. After hot rolling, the samples are acid-pickled by a usual method and then cold-rolled at a reduction ratio of 60% or more. The reason for this is that if the reduction ratio is less than 60%, satisfactory press formability cannot be obtained. Although the upper limit for the reduction ratio of the cold rolling is not specific, it is preferable that the ratio be less than 90% taking into consideration a load being applied to the rolling mill. After cold rolling, annealing for recrystallization is performed at a preferred level of less than $AC_3$ transformation temperature. If the annealing is performed at a level of more than the $AC_3$ transformation temperature, the press formability is remarkably deteriorated. After the annealing, the samples are galvanized by a usual method, and then the coating weight is adjusted. Then, galvannealing as the alloying treatment is performed. It is preferable that the galvannealing temperature be 450 to 600° C. If the temperature is less than 450° C., the alloying rate is too low and, therefore, the productivity remarkably deteriorates. What is worse, the streaky defect becomes conspicuous. If the temperature is more than 600° C., excess alloying takes place, anti-powdering property deteriorates and the streaky defect becomes conspicuous. After the galvannealing has been performed, temper rolling may be performed if necessary. In this case, the reduction ratio be in a range from 0.3 to 2%. If the product is required to have further improved press formability, a Fe—Zn alloy containing Fe in 50 wt. % or more may be electroplated on the surface of the coating layer.

TABLE 4

| C | Si | Mn | P | S | sol. Al | N | Ti |
|---|---|---|---|---|---|---|---|
| 0.0019 to | 0.01 to | 0.77 to | 0.015 to | 0.007 to | 0.045 to | 0.0019 to | 0.018 to |

TABLE 4-continued

| C | Si | Mn | P | S | sol. Al | N | Ti |
|---|---|---|---|---|---|---|---|
| 0.0024 | 0.03 | 0.82 | 0.105 | 0.011 | 0.061 | 0.0022 | 0.109 (wt %) |

EXAMPLES

Examples of the present invention will now be described. Example 1 (in the case of Mn: less than 0. 5 wt. %, P: less than 0. 02 wt. % and the grain size: to be limited)

Example 1-1

Steel having a composition shown in Table 5 was hot-rolled into a hot-rolled steel sheet in thickness of 4.0 mm and then coiled into a coil at 620° C. The hot-rolled steel sheet was acid-pickled and then cold-rolled into a cold-rolled steel sheet in thickness of 0.8 mm. The steel was continuously annealed at 850° C. and then galvanized in a coating weight of 45 g/m$^2$ per surface. Then, the steel sheet was galvannealed at 510° C. as alloying treatment. The obtained steel sheet was temper-rolled with a reduction ratio of 0.7% to obtain a final product. The press formability of the obtained steel sheet was evaluated in such a manner that a tensile test piece was extracted from the obtained product (a test piece conforming to JIS-#5) to measure the r-value. The r-value was evaluated in such a manner that those in directions of angles of 0 degree, 45 degrees and 90 degrees with regard to the rolling direction were measured and the following equation was employed to perform evaluation as mean r-value ($r_{mean}$). The surface appearance of the obtained steel sheet was evaluated in the before-mentioned five grade system.

$$r_{mean}=\tfrac{1}{4}(r_0+2r_{45}+r_{90})$$

Figure 7:
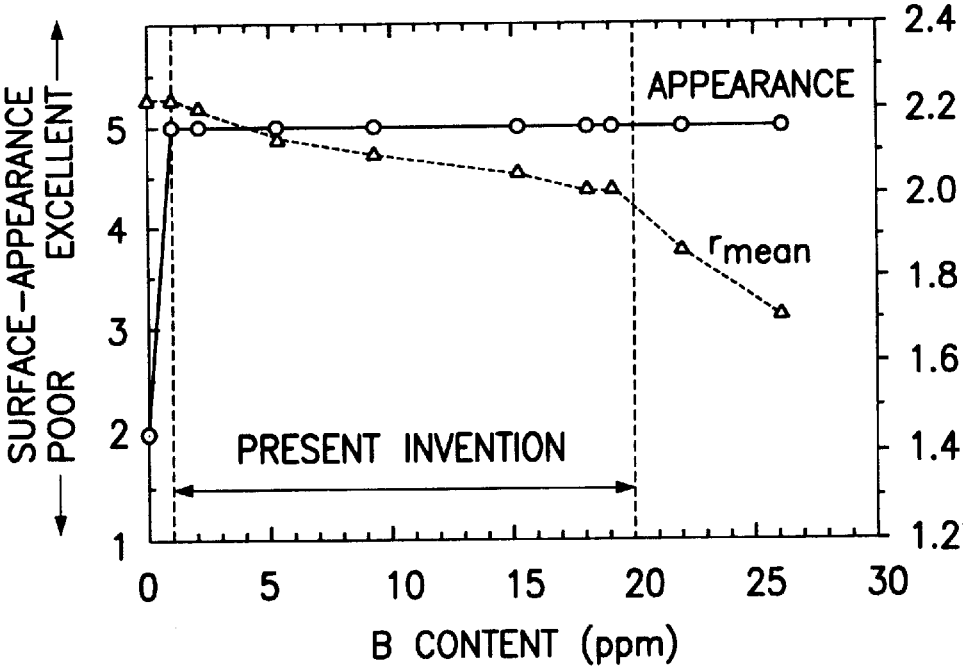
FIG. 7 is a graph showing an influence of the content of B on the surface appearance and mean r-value ($r_{mean}$) according to the present invention.
Figure 8:
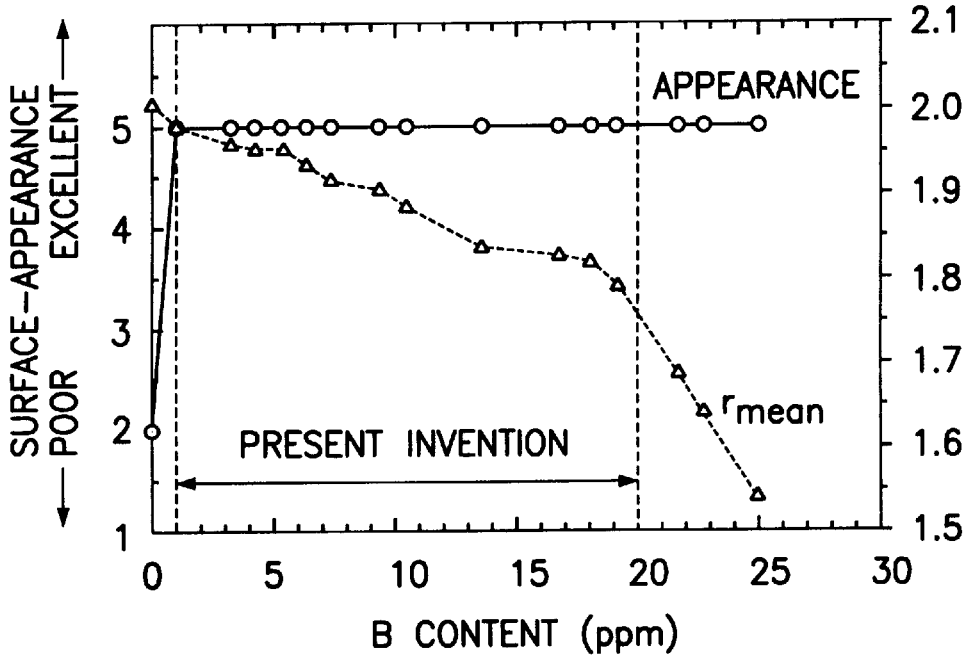
FIG. 8 is another graph showing the influence of the content of B on the surface appearance and the mean r-value ($r_{mean}$) according to the present invention.

The results were shown in FIG. 7. Although B is very effective to improve the surface appearance if it is added with a concentration of 1 ppm or more, $r_{mean}$ deteriorates remarkably if B is added with a concentration of 20 ppm.

TABLE 5

| C | Si | Mn | P | S | sol. Al | N | Ti | B |
|---|---|---|---|---|---|---|---|---|
| ≦0.0030 | ≦0.02 | 0.2 to 0.3 | 0.005 to 0.01 | 0.005 to 0.01 | 0.04 to 0.06 | ≦0.0030 | 0.04 to 0.06 | 0 to 0.0025 (wt %) |

Example 1-2

Steel samples having compositions shown in Tables 6, 7 and 8 were melted to form slab and then the slab was hot-rolled in an ordinary manner to produce hot-rolled steel sheets. The hot-rolled steel sheets were acid-pickled in a usual way and then cold-rolled into cold-rolled steel sheets in thickness of 0.7 mm. Then, the steel samples were continuously annealed at 770° C. to 880° C., and thereafter galvanized on a continuous galvanizing line in a coating weight of 60 g/m$^2$ per surface. Then, the samples were galvannealed at 470 to 550° C. and then temper-rolled with a reduction ratio of 0.7%. A portion of the samples was applied with Fe—Zn plating to the surface of the coating layer thereof to obtain a final product. The surface appearance of each of the products was evaluated by the five grade system before-mentioned. Then, tensile test pieces were extracted from the products to be subjected to mechanical tests. The $r_{mean}$ was measured by the before-mentioned method. The R value was also measured by the before-mentioned method. Results are shown in Tables 6, 7 and 8.

The steel samples of the present invention (No. 1 to No. 24 shown in Tables 6 and 7) resulted in steel sheets having satisfactory $r_{mean}$ and surface appearance being obtained. Comparative Examples 25, 27 and 28 resulted in low $r_{mean}$ because of large contents of C, Mn and P therein. Since Comparative Example 26 contains S in a large quantity, the surface appearance deteriorated. Since Comparative Example 29 contained Ti in a small quantity, $r_{mean}$ was too small. Since Comparative Example 30 contained B in a large quantity, $r_{mean}$ deteriorated. Since Comparative Examples 31, 32 and 33 (see Table 8) attained $r_{mean}$ which did not satisfy the scope of the present invention, the surface appearance deteriorated. Since Comparative Example 34 shown in Table 8 contained Nb in a large quantity, $r_{mean}$ deteriorated. Since Comparative Example 35 contained Ti in a large quantity, its $r_{mean}$ did not satisfy the scope of the present invention and the surface appearance deteriorated.

TABLE 6

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 1 | 0.0020 | 0.02 | 0.33 | 0.008 | 0.008 | 0.056 | 0.0021 | 0.046 | — | — | X | 0.92 | 2.24 | 5 | Example |
| 2 | 0.0621 | 0.01 | 0.41 | 0.007 | 0.010 | 0.049 | 0.0023 | 0.065 | — | — | X | 1.02 | 2.26 | 5 | Example |
| 3 | 0.0018 | 0.02 | 0.32 | 0.009 | 0.011 | 0.055 | 0.0020 | 0.089 | — | — | ○ | 1.03 | 2.40 | 5 | Example |
| 4 | 0.0021 | 0.03 | 0.28 | 0.009 | 0.009 | 0.048 | 0.0021 | 0.021 | — | 0.0003 | X | 1.08 | 2.05 | 5 | Example |
| 5 | 0.0022 | 0.01 | 0.25 | 0.008 | 0.007 | 0.061 | 0.0022 | 0.051 | — | 0.0005 | ○ | 1.00 | 2.06 | 5 | Example |
| 6 | 0.0025 | 0.02 | 0.29 | 0.015 | 0.006 | 0.071 | 0.0019 | 0.086 | — | 0.0004 | X | 0.98 | 2.02 | 5 | Example |
| 7 | 0.0028 | 0.02 | 0.14 | 0.018 | 0.009 | 0.048 | 0.0023 | 0.037 | — | — | X | 0.99 | 2.21 | 5 | Example |
| 8 | 0.0026 | 0.04 | 0.16 | 0.011 | 0.011 | 0.056 | 0.0024 | 0.058 | — | — | X | 1.01 | 2.18 | 5 | Example |
| 9 | 0.0021 | 0.01 | 0.22 | 0.003 | 0.007 | 0.060 | 0.0022 | 0.096 | — | — | X | 0.91 | 2.10 | 5 | Example |
| 10 | 0.0032 | 0.03 | 0.26 | 0.012 | 0.006 | 0.049 | 0.0026 | 0.044 | — | 0.0009 | ○ | 1.01 | 2.03 | 5 | Example |
| 11 | 0.0019 | 0.02 | 0.33 | 0.004 | 0.007 | 0.055 | 0.0021 | 0.060 | — | 0.0017 | X | 1.02 | 2.02 | 5 | Example |
| 12 | 0.0016 | 0.02 | 0.21 | 0.015 | 0.009 | 0.048 | 0.0019 | 0.058 | — | 0.0070 | X | 1.60 | 2.15 | 5 | Example |
| 13 | 0.0020 | 0.02 | 0.25 | 0.013 | 0.010 | 0.059 | 0.0020 | 0.122 | — | 0.0007 | ○ | 1.05 | 2.43 | 5 | Example |
| 14 | 0.0021 | 0.01 | 0.26 | 0.009 | 0.007 | 0.063 | 0.0026 | 0.108 | — | 0.0005 | X | 1.01 | 2.39 | 5 | Example |
| 15 | 0.0022 | 0.01 | 0.25 | 0.011 | 0.009 | 0.058 | 0.0021 | 0.095 | 0.009 | 0.0003 | X | 1.03 | 2.35 | 5 | Example |
| 16 | 0.0023 | 0.01 | 0.28 | 0.016 | 0.007 | 0.065 | 0.0019 | 0.088 | 0.012 | 0.0004 | ○ | 1.05 | 2.20 | 5 | Example |

Mark "○" means plating and mark "X" means not plating.

TABLE 7

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 17 | 0.0022 | 0.03 | 0.30 | 0.011 | 0.008 | 0.070 | 0.0022 | 0.075 | 0.015 | — | X | 1.07 | 2.01 | 5 | Example |
| 18 | 0.0023 | 0.02 | 0.44 | 0.017 | 0.007 | 0.065 | 0.0021 | 0.025 | 0.008 | — | X | 1.01 | 2.02 | 5 | Example |
| 19 | 0.0024 | 0.02 | 0.25 | 0.013 | 0.012 | 0.066 | 0.0019 | 0.044 | 0.009 | — | ○ | 1.03 | 2.11 | 5 | Example |
| 20 | 0.0022 | 0.03 | 0.19 | 0.011 | 0.009 | 0.072 | 0.0022 | 0.045 | 0.007 | 0.0003 | X | 1.05 | 2.08 | 5 | Example |
| 21 | 0.0025 | 0.04 | 0.22 | 0.013 | 0.008 | 0.063 | 0.0021 | 0.072 | 0.015 | 0.0005 | ○ | 1.03 | 2.07 | 5 | Example |
| 22 | 0.0022 | 0.02 | 0.31 | 0.014 | 0.007 | 0.065 | 0.0022 | 0.140 | — | 0.0008 | ○ | 1.09 | 2.40 | 5 | Example |
| 23 | 0.0023 | 0.01 | 0.25 | 0.017 | 0.009 | 0.070 | 0.0021 | 0.065 | 0.016 | — | X | 0.98 | 2.20 | 5 | Example |
| 24 | 0.0021 | 0.01 | 0.28 | 0.016 | 0.009 | 0.054 | 0.0022 | 0.138 | — | 0.0006 | X | 0.99 | 2.40 | 5 | Example |
| 25 | 0.0037* | 0.02 | 0.17 | 0.009 | 0.014 | 0.056 | 0.0028 | 0.045 | — | — | X | 1.01 | 1.77 | 5 | Comparative Example |
| 26 | 0.0021 | 0.08* | 0.16 | 0.010 | 0.009 | 0.060 | 0.0021 | 0.061 | — | — | ○ | 1.00 | 2.21 | 5 | Comparative Example |
| 27 | 0.0020 | 0.03 | 0.53* | 0.008 | 0.008 | 0.055 | 0.0026 | 0.033 | — | — | X | 1.02 | 1.83 | 5 | Comparative Example |
| 28 | 0.0022 | 0.01 | 0.22 | 0.023* | 0.009 | 0.061 | 0.0021 | 0.081 | — | — | X | 0.99 | 1.85 | 5 | Comparative Example |
| 29 | 0.0019 | 0.02 | 0.26 | 0.007 | 0.006 | 0.070 | 0.0020 | 0.003* | — | — | ○ | 1.01 | 1.71 | 5 | Comparative Example |
| 30 | 0.0018 | 0.02 | 0.28 | 0.009 | 0.013 | 0.043 | 0.0022 | 0.693 | — | 0.0024* | X | 1.02 | 1.65 | 5 | Comparative Example |
| 31 | 0.0024 | 0.03 | 0.31 | 0.006 | 0.012 | 0.052 | 0.0021 | 0.085 | — | — | X | 1.12* | 2.01 | 4 | Comparative Example |

TABLE 7-continued

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 32 | 0.0023 | 0.01 | 0.46 | 0.007 | 0.010 | 0.055 | 0.0028 | 0.099 | — | — | ○ | 0.81* | 2.25 | 1 | Comparative Example |

Asterisk "*" indicates the results out of the scope of the present invention
Mark "○" means plating and mark "X" means not plating.

TABLE 8

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 33 | 0.0021 | 0.02 | 0.25 | 0.007 | 0.010 | 0.065 | 0.0022 | 0.095 | — | — | ○ | 1.88* | 2.40 | 2 | Comparative |
| 34 | 0.0022 | 0.03 | 0.26 | 0.015 | 0.009 | 0.066 | 0.0020 | 0.078 | 0.022* | — | X | 0.98 | 1.88 | 5 | Comparative Example |
| 35 | 0.0023 | 0.01 | 0.25 | 0.011 | 0.008 | 0.058 | 0.0021 | 0.155* | — | 0.0003 | X | 1.23* | 2.44 | 1 | Comparative Example |
| 36 | | | | | | | | | | | | | | | |
| 37 | | | | | | | | | | | | | | | |
| 38 | | | | | | | | | | | | | | | |
| 39 | | | | | | | | | | | | | | | |
| 40 | | | | | | | | | | | | | | | |
| 41 | | | | | | | | | | | | | | | |
| 42 | | | | | | | | | | | | | | | |
| 43 | | | | | | | | | | | | | | | |
| 44 | | | | | | | | | | | | | | | |
| 45 | | | | | | | | | | | | | | | |
| 47 | | | | | | | | | | | | | | | |
| 48 | | | | | | | | | | | | | | | |

Asterisk "*" indicates the results out of the scope of the present invention
Mark "○" means plating and mark "X" means not plating.

Example 2 (in the case of Mn: 0.5 to 2.5 wt. %; P: 0.02 to 0.100 wt. % and the grain size: to be limited)

Example 2-1

Steel having a composition shown in Table 9 was hot-rolled into a hot-rolled steel sheet in a thickness of 4.0 mm and then coiled at 620° C. The hot-rolled steel sheet was acid-pickled and then cold-rolled into a cold-rolled steel sheet in a thickness of 0.8 mm. The steel sheet was continuously annealed at 850° C. and then galvanized in a coating weight of 45 g/m$^2$ per surface. Then, the steel was galvannealed at 510° C. The steel sheet was temper-rolled with a reduction ratio of 0.7% to obtain a final product. The press formability of the steel sheet was evaluated in such a manner that a tensile test piece was extracted from the product (a test piece conforming to JIS-#5) to measure the r-value. The r-value was evaluated in such a manner that those in directions of angles of 0 degree, 45 degrees and 90 degrees with regard to the rolling direction were measured and the following equation is employed to perform evaluation as mean r-value ($r_{mean}$). The surface appearance of the steel sheet was evaluated in the before-mentioned five grades.

$$r_{mean}=\tfrac{1}{4}(r_0+2r_{45}+r_{90})$$

Figure 9:
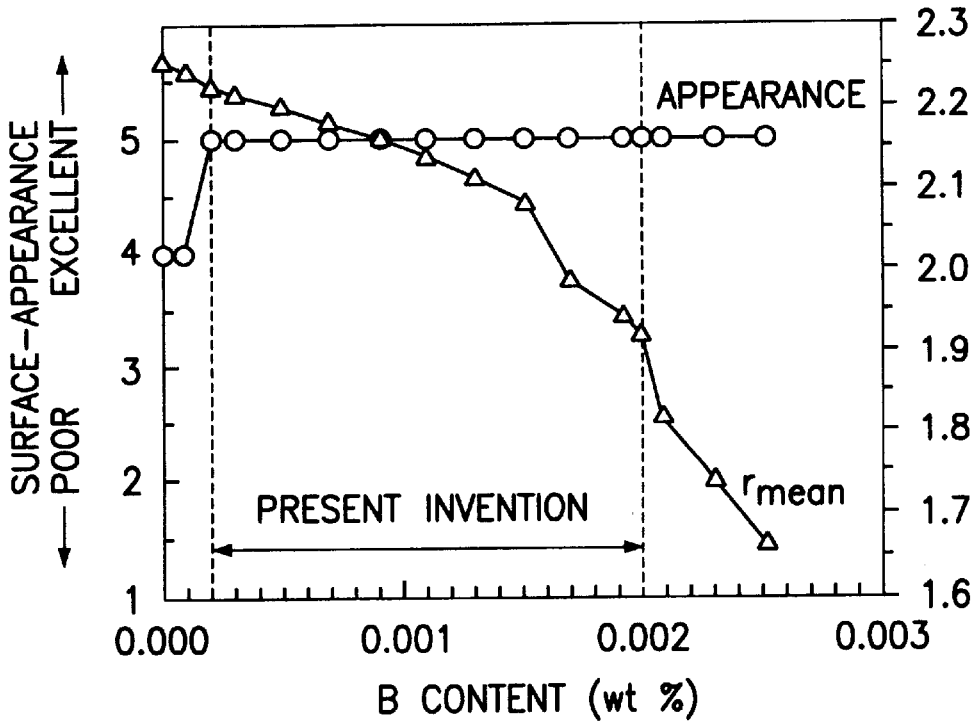
FIG. 9 is a further graph showing the influence of the content of B on the surface appearance and the mean r-value ($r_{mean}$) according to the present invention.

Results are shown in FIG. 9. Although B is very effective to improve the surface appearance if it is added with a concentration of 1 ppm or more, $r_{mean}$ deteriorates remarkably if B is added with a concentration of 20 ppm.

TABLE 9

| C | Si | Mn | P | S | sol. Al | N | Ti | B |
|---|---|---|---|---|---|---|---|---|
| ≦0.0030 | ≦0.02 | 0.6 to 0.7 | 0.045 to 0.055 | 0.005 to 0.010 | 0.04 to 0.06 | ≦0.0030 | 0.05 to 0.06 | 0 to 0.0025 |

(wt %)

Example 2-2

Steel samples having compositions shown in Tables 10, 11 and 12 were melted to form a slab and then the slab was hot-rolled in an ordinary manner into hot-rolled steel sheets. The hot-rolled steel sheets were acid-pickled in a usual way and then cold-rolled into a cold-rolled steel sheet in thickness of 0.7 mm. Then, the steel samples were continuously annealed at 770 to 880° C. and then galvanized in a coating weight of 60 g/m$^2$ per surface. Then, the samples were galvannealed at 470 to 550° C. and then temper-rolled with a reduction ratio of 0.7%. Some of the samples were applied with Fe—Zn plating to the surface of the Zn-coating layer thereof to obtain a product. The surface appearance of each of the products was evaluated in the before-mentioned five grades. Then, tensile test pieces taken from the products were subjected to mechanical tests. The $r_{mean}$ was measured by the before-mentioned method. The R value also was measured by the before-mentioned method. Results are shown in Tables 10, 11 and 12.

The steel samples of the present invention resulted in steel sheets having satisfactory $r_{mean}$ and surface appearance being obtained. Comparative Examples 22 and 24 resulted in low $r_{mean}$ because of large contents of C and Mn therein. Since Comparative Example 25 contained P in a large quantity, $r_{mean}$ and surface appearance deteriorated. Since Comparative Example 23 contained Si in a large quantity, its surface appearance deteriorated. Since Comparative Example 26 contained Mb in a large quantity, $r_{mean}$ was too small. Since Comparative Example 27 contained B in a large quantity, r deteriorated. Since Comparative Examples 28 and 29 resulted in $r_{mean}$ being out of the scope of the present invention, surface appearance deteriorated. Since Comparative Example 30 contained Ti in a large quantity, $R_{mean}$ was out of the scope of the present invention and surface appearance deteriorated. Since Comparative Example 31 contained Nb in a large quantity, $r_{mean}$ deteriorated. Since Comparative Example 32 contained Ti in a large quantity, $R_{mean}$ was out of the scope of the present invention and surface appearance deteriorated.

TABLE 10

| Sample Steel | CHEMICAL COMPOSITION (wt %) | | | | | | | | | | Plating for Upper | R | r | TS | Evaluation of Appear- | |
|---|---|---|---|---|---|---|---|---|---|---|---|---|---|---|---|---|
| No. | C | Si | Mn | P | S | sol. Al | N | Ti | Nb | B | Layer | mean | mean | (MPa) | ance | Remarks |
| 1 | 0.0020 | 0.02 | 0.65 | 0.043 | 0.008 | 0.056 | 0.0021 | 0.068 | 0.011 | — | X | 0.92 | 1.92 | 346 | 5 | Example |
| 2 | 0.0021 | 0.01 | 0.67 | 0.046 | 0.010 | 0.049 | 0.0023 | 0.069 | — | — | X | 1.02 | 1.89 | 347 | 5 | Example |
| 3 | 0.0018 | 0.02 | 0.71 | 0.050 | 0.011 | 0.055 | 0.0020 | 0.072 | — | 0.0004 | ○ | 1.03 | 1.90 | 349 | 5 | Example |
| 4 | 0.0025 | 0.02 | 0.66 | 0.022 | 0.006 | 0.071 | 0.0019 | 0.023 | — | — | ○ | 0.98 | 1.89 | 344 | 5 | Example |
| 5 | 0.0028 | 0.02 | 0.59 | 0.071 | 0.009 | 0.048 | 0.0023 | 0.079 | 0.010 | — | X | 0.99 | 1.93 | 420 | 5 | Example |
| 6 | 0.0026 | 0.04 | 0.52 | 0.093 | 0.011 | 0.056 | 0.0024 | 0.092 | — | 0.0006 | X | 1.01 | 1.82 | 460 | 5 | Example |
| 7 | 0.0021 | 0.01 | 0.63 | 0.040 | 0.007 | 0.060 | 0.0022 | 0.140 | — | 0.0006 | X | 0.91 | 2.01 | 344 | 5 | Example |
| 8 | 0.0032 | 0.03 | 1.01 | 0.025 | 0.006 | 0.049 | 0.0026 | 0.066 | — | 0.0005 | ○ | 1.01 | 1.91 | 362 | 5 | Example |
| 9 | 0.0019 | 0.02 | 1.05 | 0.030 | 0.007 | 0.055 | 0.0021 | 0.045 | 0.009 | — | X | 1.02 | 1.93 | 365 | 5 | Example |
| 10 | 0.0016 | 0.02 | 1.26 | 0.035 | 0.009 | 0.048 | 0.0019 | 0,044 | 0.009 | 0.0007 | X | 1.00 | 1.89 | 408 | 5 | Example |
| 11 | 0.0020 | 0.02 | 1.54 | 0.026 | 0.010 | 0.059 | 0.0020 | 0.050 | — | — | ○ | 1.05 | 1.92 | 430 | 5 | Example |
| 12 | 0.0021 | 0.01 | 1.89 | 0.042 | 0.007 | 0.063 | 0.0026 | 0.077 | 0.012 | — | X | 1.01 | 1.82 | 440 | 5 | Example |
| 13 | 0.0022 | 0.01 | 2.28 | 0.023 | 0.009 | 0.058 | 0.0021 | 0.068 | — | — | X | 1.03 | 1.83 | 469 | 5 | Example |
| 14 | 0.0023 | 0.01 | 1.21 | 0.060 | 0.007 | 0.065 | 0.0019 | 0.052 | — | 0.0006 | ○ | 1.65 | 1.93 | 412 | 5 | Example |
| 15 | 0.0023 | 0.02 | 2.10 | 0.030 | 0.007 | 0.065 | 0.0021 | 0.079 | — | 0.0005 | X | 1.01 | 1.82 | 454 | 5 | Example |
| 16 | 0.0024 | 0.02 | 0.65 | 0.048 | 0.012 | 0.066 | 0.0019 | 0.025 | — | 0.0007 | ○ | 1.03 | 1.99 | 347 | 5 | Example |

Mark "○" means plating and mark "X" means not plating.

TABLE 11

| Sample Steel | CHEMICAL COMPOSITION (wt %) | | | | | | | | | | Plating for Upper | R | r | TS | Evaluation of Appear- | |
|---|---|---|---|---|---|---|---|---|---|---|---|---|---|---|---|---|
| No. | C | Si | Mn | P | S | sol. Al | N | Ti | Nb | B | Layer | mean | mean | (MPa) | ance | Remarks |
| 17 | 0.0022 | 0.03 | 0.67 | 0.039 | 0.009 | 0.072 | 0.0022 | 0.045 | — | 0.0006 | X | 1.05 | 1.93 | 345 | 5 | Example |
| 18 | 0.0025 | 0.04 | 0.66 | 0.040 | 0.008 | 0.063 | 0.0021 | 0.044 | — | 0.0015 | X | 1.03 | 1.82 | 371 | 5 | Example |
| 19 | 0.0022 | 0.02 | 0.55 | 0.033 | 0.007 | 0.065 | 0.0022 | 0.065 | — | 0.0013 | ○ | 1.09 | 1.84 | 358 | 5 | Example |
| 20 | 0.0023 | 0.01 | 0.57 | 0.041 | 0.009 | 0.070 | 0.0021 | 0.088 | — | — | ○ | 0.98 | 1.99 | 347 | 5 | Example |
| 21 | 0.0021 | 0.01 | 0.58 | 0.035 | 0.009 | 0.054 | 0.0022 | 0.121 | — | — | ○ | 0.99 | 2.05 | 346 | 5 | Example |

Mark "○" means plating and mark "X" means not plating.

TABLE 12

| Sample Steel No. | CHEMICAL COMPOSITION (wt %) C | Si | Mn | P | S | sol. Al | N | Ti | Nb | B | Plating for Upper Layer | R mean | r mean | TS (MPa) | Evaluation of Appearance | Remarks |
|---|---|---|---|---|---|---|---|---|---|---|---|---|---|---|---|---|
| 22 | 0.0037* | 0.02 | 0.66 | 0.025 | 0.014 | 0.056 | 0.0028 | 0.033 | — | — | X | 1.01 | 1.70 | 364 | 5 | Comparative Example |
| 23 | 0.0021 | 0.08* | 0.88 | 0.033 | 0.009 | 0.060 | 0.0021 | 0.042 | — | 0.0005 | X | 1.00 | 1.85 | 358 | 3 | Comparative Example |
| 24 | 0.0020 | 0.03 | 2.59* | 0.028 | 0.008 | 0.055 | 0.0026 | 0.044 | 0.013 | — | X | 1.02 | 1.65 | 472 | 5 | Comparative Example |
| 25 | 0.0022 | 0.01 | 0.75 | 0.110* | 0.009 | 0.061 | 0.0021 | 0.032 | 0.011 | 0.0006 | X | 0.79* | 1.60 | 478 | 1 | Comparative Example |
| 26 | 0.0019 | 0.02 | 0.82 | 0.040 | 0.006 | 0.070 | 0.0020 | 0.042 | 0.023* | — | X | 1.01 | 1.69 | 372 | 5 | Comparative Example |
| 27 | 0.0018 | 0.02 | 0.65 | 0.033 | 0.013 | 0.048 | 0.0022 | 0.044 | — | 0.0023* | X | 1.02 | 1.59 | 373 | 5 | Comparative Example |
| 28 | 0.0024 | 0.03 | 0.77 | 0.095 | 0.012 | 0.052 | 0.0021 | 0.028 | — | — | ○ | 1.12* | 1.81 | 456 | 4 | Comparative Example |
| 29 | 0.0023 | 0.01 | 0.66 | 0.044 | 0.010 | 0.055 | 0.0028 | 0.148 | — | — | X | 0.81* | 1.93 | 344 | 1 | Comparative Example |
| 30 | 0.0021 | 0.02 | 0.67 | 0.028 | 0.010 | 0.065 | 0.0022 | 0.156* | — | — | ○ | 0.88* | 2.08 | 336 | 2 | Comparative Example |
| 31 | 0.0022 | 0.03 | 0.66 | 0.038 | 0.009 | 0.066 | 0.0020 | 0.009* | — | — | X | 0.98 | 1.73 | 352 | 5 | Comparative Example |

Asterisk "*" indicates the results out of the scope of the present invention
Mark "○" means plating and mark "X" means not plating.

Example 3 (in the case of Mn: less than 0.5 wt. %; P: less than 0.02 wt. % and the texture: to be limited)

Example 3

Steel samples having compositions shown in Tables 13, 14 and 15 (same as those shown in Tables 6, 7 and 8) were melted to form a slab and then the slab was hot-rolled in an ordinary manner to produce hot-rolled sheets. The hot-rolled steel sheets were acid-pickled in a usual method and then cold-rolled into cold-rolled steel sheets in thickness of 0.7 mm. Then, the steel samples were continuously annealed at 770 to 880° C. on a continuous galvannealing line and then galvannealed in a coating weight of 60 g/m$^2$ per surface. Then, the samples were galvannealed at 470 to 550° C. and then temper-rolled with a reduction ratio of 0.7%. Some of the samples were applied with Fe—Zn plating to the surface of the Zn-coating layer thereof to obtain a final product. The surface appearance of each of the products was evaluated in the five grades before-mentioned. Then, tensile test pieces taken from the products were subjected to mechanical tests. The man was measured by the before-mentioned method. The $R_{mean}$ also was measured by the before-mentioned method. Results were shown in Table 13.

The steel samples of the present invention resulted in steel sheets having satisfactory $r_{mean}$ and surface appearance being obtained. Since Comparative Examples 25, 27 and 28 contained C, Mn and P in large quantities, $r_{mean}$ was too small. Since Comparative Example 26 contained Si in a large quantity, surface appearance deteriorated. Since Comparative Example 29 contained Ti in a small quantity, $r_{mean}$ was too small. Since Comparative Example 30 contained B in a large quantity, $r_{mean}$ deteriorated. Since Comparative Examples 31, 32 and 33 made $R_{mean}$ out of the scope of the present invention, surface appearance deteriorated. Since Comparative Example 34 contained N in a large quantity, $r_{mean}$ deteriorated. Since Comparative Example 35 contained Ti in a large quantity, surface appearance deteriorated.

TABLE 13

| Sample Steel No. | CHEMICAL COMPOSITION (wt %) C | Si | Mn | P | S | sol. Al | N | Ti | Nb | B | Plating for Upper Layer | R mean | r mean | Evaluation of Appearance | Remarks |
|---|---|---|---|---|---|---|---|---|---|---|---|---|---|---|---|
| 1 | 0.0020 | 0.02 | 0.33 | 0.008 | 0.008 | 0.056 | 0.0021 | 0.046 | — | — | X | 1.23 | 2.24 | 5 | Example |
| 2 | 0.0621 | 0.01 | 0.41 | 0.007 | 0.010 | 0.049 | 0.0023 | 0.065 | — | — | X | 1.36 | 2.26 | 5 | Example |
| 3 | 0.0018 | 0.02 | 0.32 | 0.009 | 0.011 | 0.055 | 0.0020 | 0.089 | — | — | ○ | 1.50 | 2.40 | 5 | Example |
| 4 | 0.0021 | 0.03 | 0.28 | 0.009 | 0.009 | 0.048 | 0.0021 | 0.021 | — | 0.0003 | X | 1.08 | 2.05 | 5 | Example |
| 5 | 0.0022 | 0.01 | 0.25 | 0.008 | 0.007 | 0.061 | 0.0022 | 0.051 | — | 0.0005 | ○ | 1.05 | 2.06 | 5 | Example |
| 6 | 0.0025 | 0.02 | 0.29 | 0.015 | 0.006 | 0.071 | 0.0019 | 0.086 | — | 0.0004 | X | 0.98 | 2.02 | 5 | Example |
| 7 | 0.0028 | 0.02 | 0.14 | 0.018 | 0.009 | 0.048 | 0.0023 | 0.037 | — | — | X | 1.37 | 2.21 | 5 | Example |

TABLE 13-continued

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 8 | 0.0026 | 0.04 | 0.16 | 0.011 | 0.011 | 0.056 | 0.0024 | 0.058 | — | — | X | 1.55 | 2.18 | 5 | Example |
| 9 | 0.0021 | 0.01 | 0.22 | 0.003 | 0.007 | 0.060 | 0.0022 | 0.096 | — | — | X | 1.89 | 2.10 | 5 | Example |
| 10 | 0.0032 | 0.03 | 0.26 | 0.012 | 0.006 | 0.049 | 0.0026 | 0.044 | — | 0.0009 | ○ | 1.12 | 2.03 | 5 | Example |
| 11 | 0.0019 | 0.02 | 0.33 | 0.004 | 0.007 | 0.055 | 0.0021 | 0.060 | — | 0.0017 | X | 0.89 | 2.02 | 5 | Example |
| 12 | 0.0016 | 0.02 | 0.21 | 0.015 | 0.009 | 0.048 | 0.0019 | 0.058 | — | 0.0070 | X | 0.99 | 2.15 | 5 | Example |
| 13 | 0.0020 | 0.02 | 0.25 | 0.013 | 0.010 | 0.059 | 0.0020 | 0.122 | — | 0.0007 | ○ | 0.53 | 2.43 | 5 | Example |
| 14 | 0.0021 | 0.01 | 0.26 | 0.009 | 0.007 | 0.063 | 0.0026 | 0.108 | — | 0.0005 | X | 1.67 | 2.39 | 5 | Example |
| 15 | 0.0022 | 0.01 | 0.25 | 0.011 | 0.009 | 0.058 | 0.0021 | 0.095 | 0.009 | 0.0003 | X | 1.44 | 2.35 | 5 | Example |
| 16 | 0.0023 | 0.01 | 0.28 | 0.016 | 0.007 | 0.065 | 0.0019 | 0.088 | 0.012 | 0.0004 | ○ | 1.36 | 2.20 | 5 | Example |

Asterisk "*" indicates the results out of the scope of the present invention
Mark "○" means plating and mark "X" means not plating.

TABLE 14

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 17 | 0.0022 | 0.03 | 0.30 | 0.011 | 0.008 | 0.070 | 0.0022 | 0.075 | 0.015 | — | X | 1.57 | 2.01 | 5 | Example |
| 18 | 0.0023 | 0.02 | 0.44 | 0.017 | 0.007 | 0.065 | 0.0021 | 0.025 | 0.008 | — | X | 1.00 | 2.02 | 5 | Example |
| 19 | 0.0024 | 0.02 | 0.25 | 0.013 | 0.012 | 0.066 | 0.0019 | 0.044 | 0.009 | — | ○ | 0.98 | 2.11 | 5 | Example |
| 20 | 0.0022 | 0.03 | 0.19 | 0.011 | 0.009 | 0.072 | 0.0022 | 0.045 | 0.007 | 0.0003 | X | 1.02 | 2.08 | 5 | Example |
| 21 | 0.0025 | 0.04 | 0.22 | 0.013 | 0.008 | 0.063 | 0.0021 | 0.072 | 0.015 | 0.0005 | X | 1.38 | 2.07 | 5 | Example |
| 22 | 0.0022 | 0.02 | 0.31 | 0.014 | 0.007 | 0.065 | 0.0022 | 0.140 | — | 0.0008 | ○ | 1.76 | 2.40 | 5 | Example |
| 23 | 0.0023 | 0.01 | 0.25 | 0.017 | 0.009 | 0.070 | 0.0021 | 0.065 | 0.016 | — | ○ | 1.09 | 2.20 | 5 | Example |
| 24 | 0.0021 | 0.01 | 0.28 | 0.016 | 0.009 | 0.054 | 0.0022 | 0.138 | — | 0.0006 | X | 0.88 | 2.40 | 5 | Example |
| 25 | 0.0037* | 0.02 | 0.17 | 0.009 | 0.014 | 0.056 | 0.0028 | 0.045 | — | — | X | 1.38 | 1.77 | 5 | Comparative Example |
| 26 | 0.0021 | 0.08* | 0.16 | 0.010 | 0.009 | 0.060 | 0.0021 | 0.061 | — | — | X | 1.26 | 2.21 | 3 | Comparative Example |
| 27 | 0.0020 | 0.03 | 0.53* | 0.008 | 0.008 | 0.055 | 0.0026 | 0.033 | — | — | X | 0.99 | 1.83 | 5 | Comparative Example |
| 28 | 0.0022 | 0.01 | 0.22 | 0.023* | 0.009 | 0.061 | 0.0021 | 0.081 | — | — | X | 1.70 | 1.85 | 5 | Comparative Example |
| 29 | 0.0019 | 0.02 | 0.26 | 0.007 | 0.006 | 0.070 | 0.0020 | 0.003* | — | — | X | 1.05 | 1.71 | 5 | Comparative Example |
| 30 | 0.0018 | 0.02 | 0.28 | 0.009 | 0.013 | 0.043 | 0.0022 | 0.693 | — | 0.0024* | X | 1.01 | 1.65 | 5 | Comparative Example |
| 31 | 0.0024 | 0.03 | 0.31 | 0.006 | 0.012 | 0.052 | 0.0021 | 0.085 | — | — | ○ | 2.05* | 2.01 | 4 | Comparative Example |
| 32 | 0.0023 | 0.01 | 0.46 | 0.007 | 0.010 | 0.055 | 0.0028 | 0.099 | — | — | X | 0.04* | 2.25 | 2 | Comparative Example |

Asterisk "*" indicates the results out of the scope of the present invention
Mark "○" means plating and mark "X" means not plating.

TABLE 15

| Sample Steel | CHEMICAL COMPOSITION (wt %) | | | | | | | | | | Plating for Upper | R | r | Evaluation of Ap- | |
|---|---|---|---|---|---|---|---|---|---|---|---|---|---|---|---|
| No. | C | Si | Mn | P | S | sol. Al | N | Ti | Nb | B | Layer | mean | mean | pearance | Remarks |
| 33 | 0.0021 | 0.02 | 0.25 | 0.007 | 0.010 | 0.065 | 0.0022 | 0.095 | — | — | ○ | 2.23* | 2.40 | 1 | Comparative |
| 34 | 0.0022 | 0.03 | 0.26 | 0.015 | 0.009 | 0.066 | 0.0020 | 0.078 | 0.022* | — | X | 1.12 | 1.88 | 5 | Comparative Example |
| 35 | 0.0023 | 0.01 | 0.25 | 0.011 | 0.008 | 0.058 | 0.0021 | 0.155* | — | 0.0003 | X | 2.21* | 2.44 | 1 | Comparative Example |
| 36 | | | | | | | | | | | | | | | |
| 37 | | | | | | | | | | | | | | | |

TABLE 15-continued

| Sample Steel No. | CHEMICAL COMPOSITION (wt %) C | Si | Mn | P | S | sol. Al | N | Ti | Nb | B | Plating for Upper Layer | R mean | r mean | Evaluation of Appearance | Remarks |
|---|---|---|---|---|---|---|---|---|---|---|---|---|---|---|---|
| 38 | | | | | | | | | | | | | | | |
| 39 | | | | | | | | | | | | | | | |
| 40 | | | | | | | | | | | | | | | |
| 41 | | | | | | | | | | | | | | | |
| 42 | | | | | | | | | | | | | | | |
| 43 | | | | | | | | | | | | | | | |
| 44 | | | | | | | | | | | | | | | |
| 45 | | | | | | | | | | | | | | | |
| 47 | | | | | | | | | | | | | | | |
| 48 | | | | | | | | | | | | | | | |

Asterisk "*" indicates the results out of the scope of the present invention
Mark "○" means plating and mark "X" means not plating.

Example 4 (in the case of Mn: 0.5 to 2.5 wt. %; P: 0.02 to 0.100 wt. % and the texture: to be limited)

Steel samples having compositions shown in Tables 16, 17 and 18 (same as those shown in Tables 10, 11 and 12) were melted to form a slab and then the slab was hot-rolled in an ordinary manner into hot-rolled sheets. The hot-rolled steel sheets were acid-pickled in a usual way and then cold-rolled into cold-rolled steel sheets in thickness of 0.7 mm. Then, the steel samples were continuously annealed at 770 to 880° C. and then galvanized in a coating weight of 60 g/m$^2$ per surface. Then, the samples were galvannealed at 470 to 550° C. and then temper-rolled with with a reduction ratio of 0.7%. A portion of the samples was applied with Fe—Zn plating to the surface of the coating layer thereof to obtain a final product. The surface appearance of each of the obtained products was evaluated by the five grade system before-mentioned. Then, tensile test pieces taken from the products were subjected to mechanical tests. The $r_{mean}$ was measured by the before-mentioned method. The $r_{mean}$ also was measured by the before-mentioned method. The results are shown in Tables 16, 17 and 18.

The steel samples of the present invention resulted in steel sheets having satisfactory $r_{mean}$ and surface appearance being obtained. Since Comparative Examples 22 and 24 contained C and M in large quantities, $r_{mean}$ was too small. Since Comparative Example 25 contained P in a large quantity, surface appearance deteriorated. Since Comparative Example 23 contained Si in a large quantity, surface appearance deteriorated. Since Comparative Example 26 contained Nb in a large quantity, $r_{mean}$ was too small. Since Comparative Example 27 contained B in a large quantity, $r_{mean}$ deteriorated. Since Comparative Examples 28, 29 and 30 attained $R_{mean}$ out of the scope of the present invention, surface appearance deteriorated. Since Comparative Example 31 contained Ti in a small quantity, $r_{mean}$ deteriorated.

TABLE 16

| Sample Steel No. | CHEMICAL COMPOSITION (wt %) C | Si | Mn | P | S | sol. Al | N | Ti | Nb | B | Plating for Upper Layer | R mean | r mean | TS (MPa) | Evaluation of Appearance | Remarks |
|---|---|---|---|---|---|---|---|---|---|---|---|---|---|---|---|---|
| 1 | 0.0020 | 0.02 | 0.65 | 0.043 | 0.008 | 0.056 | 0.0021 | 0.068 | 0.011 | — | X | 1.09 | 1.92 | 346 | 5 | Example |
| 2 | 0.0021 | 0.01 | 0.67 | 0.046 | 0.010 | 0.049 | 0.0023 | 0.069 | — | — | X | 1.23 | 1.89 | 347 | 5 | Example |
| 3 | 0.0018 | 0.02 | 0.71 | 0.050 | 0.011 | 0.055 | 0.0020 | 0.072 | — | 0.0004 | ○ | 1.35 | 1.90 | 349 | 5 | Example |
| 4 | 0.0025 | 0.02 | 0.66 | 0.022 | 0.006 | 0.071 | 0.0019 | 0.023 | — | — | ○ | 0.77 | 1.89 | 344 | 5 | Example |
| 5 | 0.0028 | 0.02 | 0.59 | 0.071 | 0.009 | 0.048 | 0.0023 | 0.079 | 0.010 | — | X | 1.05 | 1.93 | 420 | 5 | Example |
| 6 | 0.0026 | 0.04 | 0.52 | 0.093 | 0.011 | 0.056 | 0.0024 | 0.092 | — | 0.0006 | X | 1.88 | 1.82 | 460 | 5 | Example |
| 7 | 0.0021 | 0.01 | 0.63 | 0.040 | 0.007 | 0.060 | 0.0022 | 0.140 | — | 0.0006 | X | 1.92 | 2.01 | 344 | 5 | Example |
| 3 | 0.0032 | 0.03 | 1.01 | 0.025 | 0.006 | 0.049 | 0.0026 | 0.066 | — | 0.0005 | ○ | 1.07 | 1.91 | 362 | 5 | Example |
| 9 | 0.0019 | 0.02 | 1.05 | 0.030 | 0.007 | 0.055 | 0.0021 | 0.045 | 0.009 | — | X | 1.01 | 1.93 | 365 | 5 | Example |
| 10 | 0.0016 | 0.02 | 1.26 | 0.035 | 0.009 | 0.048 | 0.0019 | 0,044 | 0.009 | 0.0007 | X | 0.96 | 1.89 | 408 | 5 | Example |
| 11 | 0.0020 | 0.02 | 1.54 | 0.026 | 0.010 | 0.059 | 0.0020 | 0.050 | — | — | ○ | 0.53 | 1.92 | 430 | 5 | Example |
| 12 | 0.0021 | 0.01 | 1.89 | 0.042 | 0.007 | 0.063 | 0.0026 | 0.077 | 0.012 | — | X | 1.36 | 1.82 | 440 | 5 | Example |
| 13 | 0.0022 | 0.01 | 2.28 | 0.023 | 0.009 | 0.058 | 0.0021 | 0.068 | — | — | X | 1.45 | 1.83 | 469 | 5 | Example |
| 14 | 0.0023 | 0.01 | 1.21 | 0.060 | 0.007 | 0.065 | 0.0019 | 0.052 | — | 0.0006 | ○ | 1.46 | 1.93 | 412 | 5 | Example |
| 15 | 0.0023 | 0.02 | 2.10 | 0.030 | 0.007 | 0.065 | 0.0021 | 0.079 | — | 0.0005 | X | 1.05 | 1.82 | 454 | 5 | Example |
| 16 | 0.0024 | 0.02 | 0.65 | 0.048 | 0.012 | 0.066 | 0.0019 | 0.025 | — | 0.0007 | ○ | 1.09 | 1.99 | 347 | 5 | Example |

Mark "○" means plating and mark "X" means not plating.

TABLE 17

| Sample Steel No. | CHEMICAL COMPOSITION (wt %) C | Si | Mn | P | S | sol. Al | N | Ti | Nb | B | Plating for Upper Layer | R mean | r mean | TS (MPa) | Evaluation of Appearance | Remarks |
|---|---|---|---|---|---|---|---|---|---|---|---|---|---|---|---|---|
| 17 | 0.0022 | 0.03 | 0.67 | 0.039 | 0.009 | 0.072 | 0.0022 | 0.045 | — | 0.0006 | X | 1.25 | 1.93 | 345 | 5 | Example |
| 18 | 0.0025 | 0.04 | 0.66 | 0.040 | 0.008 | 0.063 | 0.0021 | 0.044 | — | 0.0015 | X | 1.05 | 1.82 | 371 | 5 | Example |
| 19 | 0.0022 | 0.02 | 0.55 | 0.033 | 0.007 | 0.065 | 0.0022 | 0.065 | — | 0.0013 | ○ | 1.06 | 1.84 | 358 | 5 | Example |
| 20 | 0.0023 | 0.01 | 0.57 | 0.041 | 0.009 | 0.070 | 0.0021 | 0.088 | — | — | ○ | 1.22 | 1.99 | 347 | 5 | Example |
| 21 | 0.0021 | 0.01 | 0.58 | 0.035 | 0.009 | 0.054 | 0.0022 | 0.121 | — | — | X | 1.39 | 2.05 | 346 | 5 | Example |

Mark "○" means plating and mark "X" means not plating.

TABLE 18

| Sample Steel No. | CHEMICAL COMPOSITION (wt %) C | Si | Mn | P | S | sol. Al | N | Ti | Nb | B | Plating for Upper Layer | R mean | r mean | TS (MPa) | Evaluation of Appearance | Remarks |
|---|---|---|---|---|---|---|---|---|---|---|---|---|---|---|---|---|
| 22 | 0.0037* | 0.02 | 0.66 | 0.025 | 0.014 | 0.056 | 0.0028 | 0.033 | — | — | X | 1.25 | 1.70 | 364 | 5 | Comparative Example |
| 23 | 0.0021 | 0.08* | 0.88 | 0.033 | 0.009 | 0.060 | 0.0021 | 0.042 | — | 0.0005 | X | 1.18 | 1.85 | 358 | 3 | Comparative Example |
| 24 | 0.0020 | 0.03 | 2.59* | 0.028 | 0.008 | 0.055 | 0.0026 | 0.044 | 0.013 | — | X | 1.29 | 1.65 | 472 | 5 | Comparative Example |
| 25 | 0.0022 | 0.01 | 0.75 | 0.110* | 0.009 | 0.061 | 0.0021 | 0.032 | 0.011 | 0.0006 | X | 2.09* | 1.60 | 478 | 1 | Comparative Example |
| 26 | 0.0019 | 0.02 | 0.82 | 0.040 | 0.006 | 0.070 | 0.0020 | 0.042 | 0.023* | — | X | 1.13 | 1.69 | 372 | 5 | Comparative Example |
| 27 | 0.0018 | 0.02 | 0.65 | 0.033 | 0.013 | 0.048 | 0.0022 | 0.044 | — | 0.0023* | X | 1.05 | 1.59 | 373 | 5 | Comparative Example |
| 28 | 0.0024 | 0.03 | 0.77 | 0.095 | 0.012 | 0.052 | 0.0021 | 0.028 | — | — | ○ | 0.45* | 1.81 | 456 | 4 | Comparative Example |
| 29 | 0.0023 | 0.01 | 0.66 | 0.044 | 0.010 | 0.055 | 0.0028 | 0.148 | — | — | X | 2.09* | 1.93 | 344 | 2 | Comparative Example |
| 30 | 0.0021 | 0.02 | 0.67 | 0.028 | 0.010 | 0.065 | 0.0022 | 0.156* | — | — | ○ | 2.25* | 2.08 | 336 | 1 | Comparative Example |
| 31 | 0.0022 | 0.03 | 0.66 | 0.038 | 0.009 | 0.066 | 0.0020 | 0.009* | — | — | X | 1.11 | 1.73 | 352 | 5 | Comparative Example |

Asterisk "*" indicates the results out of the scope of the present invention
Mark "○" means plating and mark "X" means not plating.

Example 5 (in the case of Mn: less than 0.5 wt. %; P: less than 0.02 wt. % and the soaking temperature: to be controlled)

Example 5-1

Steel samples having compositions shown in Table 19 were melted to form slabs and then the slabs were soaked at 1180° C. for 60 minutes, followed by being hot-rolled into hot-rolled steel sheets in thickness of 3.6 mm. Then, the hot-rolled steel sheets were coiled at 640° C. The hot-rolled steel sheets were acid-pickled and then cold-rolled into cold-rolled steel sheets in thickness of 0.7 mm. Then, the cold-rolled steel sheets were continuously annealed at 850° C. and then immediately galvanized in a coating weight of 60 g/m$^2$ per surface. Then, the samples were galvannealed at 500° C. and then temper-rolled with a reduction ratio of 0.7% to obtain final products. The surface appearance of each of the products was evaluated in accordance with the foregoing criteria. Then, test pieces conforming to JIS-#5 were extracted from the product to measure r-value (deep drawability). Results were shown in FIG. 9. When the samples satisfied the scope of the present invention, steel sheets having excellent surface appearance and deep drawability were obtained.

TABLE 19

| C | Si | Mn | P | S | sol. Al | N | Ti | B |
|---|---|---|---|---|---|---|---|---|
| 0.0019 to 0.0022 | 0.01 to 0.02 | 0.15 to 0.18 | 0.015 to 0.017 | 0.006 to 0.009 | 0.048 to 0.055 | 0.0019 to 0.0024 | 0.0944 to 0.101 | 0 to 0.0025 (wt %) |

Example 5-2

Figure 10:
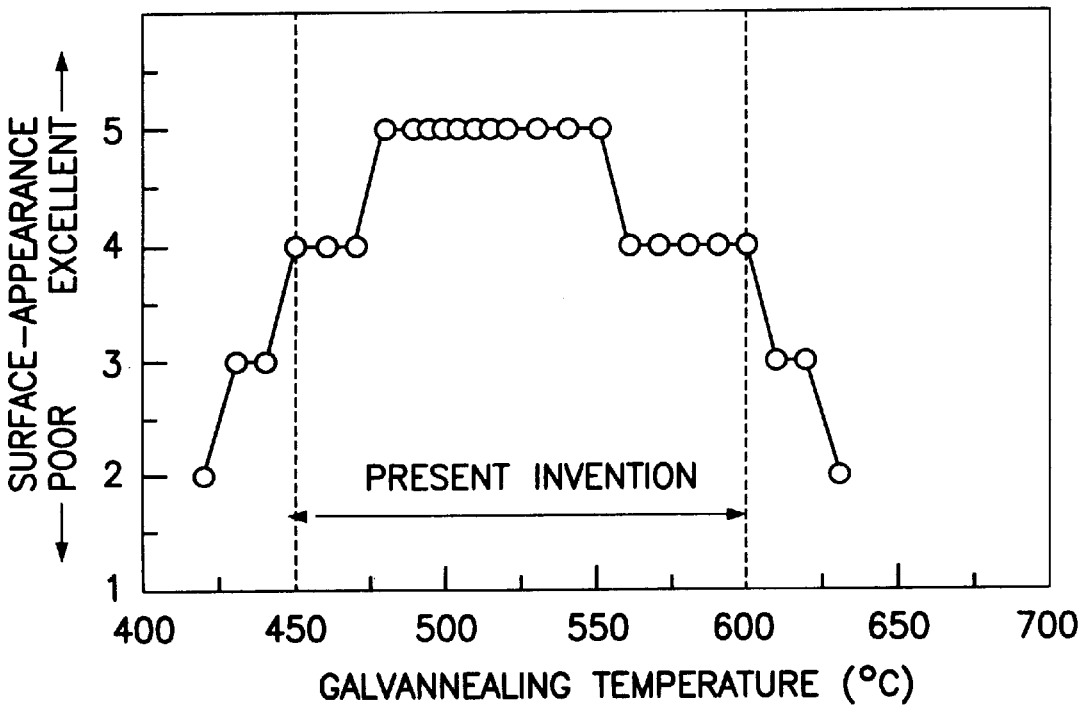
FIG. 10 is a graph showing the relationship between galvannealing temperature and the surface appearance according to the present invention.

Steel samples having compositions shown in Table 20 were melted to form slabs and then the slabs were soaked at 1180° C. for 50 minutes, followed by being hot-rolled into hot-rolled steel sheets in thickness of 3.6 mm. Then, the hot-rolled steel sheets were coiled at 680° C. The hot-rolled steel sheets were acid-pickled and then cold-rolled into cold-rolled steel sheets in thickness of 0.7 mm. Then, the cold-rolled steel sheets were continuously annealed at 850° C. and then immediately galvanized in a coating weight of 60 g/m$^2$ per surface. Then, the galvanized steel sheets were galvannealed at 420 to 630° C. and then temper-rolled with a reduction ratio of 0.7% to form final products. The surface appearance of each of the products was evaluated in accordance with the foregoing criteria. The results were shown in FIG. 10. When the samples satisfied the scope of the present invention, steel sheets having excellent surface appearance were obtained.

TABLE 20

| C | Si | Mn | P | S | sol. Al | N | Ti | −615[% Ti] + 1160 | −385[% Ti] + 1230 |
|---|---|---|---|---|---|---|---|---|---|
| 0.0018 | 0.02 | 0.26 | 0.011 | 0.009 | 0.056 | 0.0021 | 0.064 | 1121 | 1205 (wt %) |

Example 5-3

Steel samples having compositions shown in Tables 21, 23 and 25 were melted to form slabs and then the slabs were soaked at 1180° C. for 45 to 70 minutes, followed by being hot-rolled into hot-rolled steel sheets in thickness of 3.2 mm (Nos. 1 to 30 were examples of the present invention, Nos. 40 to 53 were comparative examples each having a composition out of the scope of the present invention and Nos. 54 to 59 were comparative examples, the manufacturing conditions of which were out of the scope of the present invention). The obtained hot-rolled steel sheets were acid-pickled and then cold-rolled into cold-rolled steel sheets in thickness of 0.8 mm. Then, the cold-rolled steel sheets were continuously annealed at 780 to 930° C. and then immediately galvanized in a coating weight of 60 g/m$^2$ per surface. The galvanized steel sheets were galvannealed at 440 to 610° C. Then, the samples were temper-rolled at reduction ratios of 0.5 to 1.0%. The manufacturing conditions were shown in Tables 22, 24 and 26. Some of the products were applied with Fe—Zn alloy electroplating on the the Zn-coating layer. Test pieces conforming to JIS-#5 were taken from the products to perform tensile tests and the surface appearance of each sample was evaluated in accordance with the foregoing criteria. The results are collectively shown in Tables 22, 24 and 26. As can be understood from the foregoing tables, the present invention enables steel sheets having excellent surface appearance and formability to be manufactured. Since Comparative Examples 40, 42, 43 and 44 contained C, Mn, P and S, r-value of the steel sheets deteriorated. Since Comparative Example 41 contained Si in a large quantity, surface appearance deteriorated. Since Comparative Examples 45 and 46 contained Al in a quantity out of the scope of the present invention, the r-value deteriorated. Since Comparative Example 47 contained N in a large quantity, the r-value deteriorated. Since Comparative Example 48 contained Ti in a small quantity, the r-value deteriorated. Since Comparative Example 49 contained Ti in a large quantity, surface appearance deteriorated. Since Comparative Examples 50 and 52 contained Nb and B in small quantities, surface appearance deteriorated. Since Comparative Examples 51 and 53 contained Nb and B in large quantities, the r-value deteriorated. Since Comparative Example 54 was heated at an excessively high temperature, surface appearance deteriorated. Since Comparative Examples 55 and 56 were coiled at a temperature out of the scope of the present invention, the r-value deteriorated. Since Comparative Example 57 was annealed at a level higher than the Ar3 transformation temperature, the r-value deteriorated. Since Comparative Examples 58 and 59 were galvannealed a temperature out of the scope of the present invention, surface appearance deteriorated.

TABLE 21

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 1 | 0.0012 | 0.01 | 0.21 | 0.012 | 0.006 | 0.054 | 0.0021 | 0.082 | — | — |
| 2 | 0.0019 | 0.02 | 0.20 | 0.011 | 0.007 | 0.060 | 0.0022 | 0.086 | — | — |
| 3 | 0.0026 | 0.01 | 0.22 | 0.014 | 0.007 | 0.060 | 0.0021 | 0.084 | — | — |
| 4 | 0.0038 | 0.02 | 0.24 | 0.016 | 0.008 | 0.056 | 0.0022 | 0.079 | — | — |
| 5 | 0.0021 | 0.04 | 0.26 | 0.015 | 0.009 | 0.066 | 0.0021 | 0.080 | — | — |
| 6 | 0.0019 | 0.02 | 0.38 | 0.014 | 0.010 | 0.058 | 0.2022 | 0.082 | — | — |
| 7 | 0.0019 | 0.02 | 0.14 | 0.011 | 0.008 | 0.059 | 0.0021 | 0.080 | — | — |
| 8 | 0.0018 | 0.02 | 0.20 | 0.019 | 0.008 | 0.066 | 0.0019 | 0.082 | — | — |
| 9 | 0.0017 | 0.02 | 0.21 | 0.003 | 0.009 | 0.054 | 0.0020 | 0.083 | — | — |
| 10 | 0.0020 | 0.02 | 0.22 | 0.009 | 0.003 | 0.055 | 0.0021 | 0.084 | — | — |
| 11 | 0.0019 | 0.01 | 0.20 | 0.011 | 0.008 | 0.092 | 0.0023 | 0.085 | — | — |
| 12 | 0.0020 | 0.02 | 0.22 | 0.013 | 0.009 | 0.055 | 0.0022 | 0.023 | — | — |

TABLE 21-continued

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 13 | 0.0022 | 0.01 | 0.24 | 0.011 | 0.027 | 0.060 | 0.0019 | 0.041 | — | — |
| 14 | 0.0021 | 0.02 | 0.25 | 0.013 | 0.009 | 0.061 | 0.0020 | 0.068 | — | — |
| 15 | 0.0023 | 0.01 | 0.21 | 0.011 | 0.007 | 0.058 | 0.0019 | 0.101 | — | — |
| 16 | 0.0021 | 0.02 | 0.22 | 0.009 | 0.009 | 0.055 | 0.0021 | 0.148 | — | — |
| 17 | 0.0022 | 0.01 | 0.21 | 0.008 | 0.010 | 0.056 | 0.0022 | 0.059 | — | — |
| 18 | 0.0021 | 0.02 | 0.22 | 0.011 | 0.011 | 0.055 | 0.0019 | 0.062 | — | — |
| 19 | 0.0022 | 0.02 | 0.24 | 0.009 | 0.007 | 0.058 | 0.0022 | 0.264 | | |
| 20 | 0.0023 | 0.01 | 0.22 | 0.009 | 0.006 | 0.066 | 0.0021 | 0.055 | — | — |
| 21 | 0.0022 | 0.02 | 0.23 | 0.016 | 0.011 | 0.058 | 0.0022 | 0.059 | — | — |
| 22 | 0.0022 | 0.01 | 0.22 | 0.011 | 0.008 | 0.065 | 0.0019 | 0.054 | — | — |
| 23 | 0.0021 | 0.01 | 0.24 | 0.009 | 0.007 | 0.048 | 0.0022 | 0.060 | — | — |

20

TABLE 22

| Sample Steel No. | −615[Ti %] + 1160 | −385[Ti %] + 1230 | Temp. for Heating (° C.) | Coiling Temp. (° C.) | Annealing Temp. (° C.) | Alloying Temp. (° C.) | r Value | Appearance | Remarks |
|---|---|---|---|---|---|---|---|---|---|
| 1 | 1110 | 1198 | 1190 | 680 | 850 | 505 | 2.31 | 4 | Example |
| 2 | 1107 | 1197 | 1180 | 680 | 840 | 510 | 2.30 | 5 | Example |
| 3 | 1108 | 1198 | 1120 | 670 | 880 | 500 | 2.39 | 5 | Example |
| 4 | 1111 | 1120 | 1190 | 660 | 850 | 495 | 2.28 | 5 | Example |
| 5 | 1111 | 1199 | 1180 | 680 | 860 | 495 | 2.30 | 5 | Example |
| 6 | 1110 | 1198 | 1190 | 640 | 840 | 505 | 2.31 | 5 | Example |
| 7 | 1111 | 1199 | 1190 | 620 | 850 | 495 | 2.33 | 5 | Example |
| 8 | 1110 | 1198 | 1190 | 600 | 850 | 500 | 2.36 | 5 | Example |
| 9 | 1109 | 1198 | 1120 | 580 | 850 | 500 | 2.29 | 5 | Example |
| 10 | 1108 | 1198 | 1150 | 680 | 850 | 500 | 2.28 | 5 | Example |
| 11 | 1108 | 1197 | 1170 | 670 | 860 | 495 | 2.27 | 5 | Example |
| 12 | 1146 | 1221 | 1200 | 640 | 870 | 590 | 2.01 | 5 | Example |
| 13 | 1135 | 1214 | 1190 | 640 | 880 | 495 | 2.13 | 5 | Example |
| 14 | 1118 | 1204 | 1190 | 650 | 850 | 500 | 2.25 | 5 | Example |
| 15 | 1098 | 1191 | 1180 | 650 | 830 | 505 | 2.38 | 4 | Example |
| 16 | 1069 | 1173 | 1170 | 660 | 830 | 515 | 2.42 | 4 | Example |
| 17 | 1124 | 1207 | 1200 | 680 | 800 | 460 | 2.26 | 5 | Example |
| 18 | 1122 | 1206 | 1180 | 510 | 810 | 495 | 2.28 | 5 | Example |
| 19 | 1121 | 1205 | 1190 | 690 | 780 | 500 | 2.15 | 5 | Example |
| 20 | 1126 | 1209 | 1190 | 680 | 810 | 505 | 2.10 | 5 | Example |
| 21 | 1124 | 1207 | 1190 | 640 | 850 | 510 | 2.12 | 5 | Example |
| 22 | 1127 | 1209 | 1190 | 630 | 850 | 515 | 2.13 | 5 | Example |
| 23 | 1123 | 1207 | 1190 | 620 | 850 | 510 | 2.15 | 5 | Example |

TABLE 23

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 24 | 0.0020 | 0.02 | 0.24 | 0.016 | 0.007 | 0.054 | 0.0019 | 0.044 | 0.011 | — |
| 25 | 0.0019 | 0.01 | 0.22 | 0.008 | 0.006 | 0.055 | 0.0020 | 0.046 | 0.006 | — |
| 26 | 0.0020 | 0.02 | 0.23 | 0.009 | 0.009 | 0.060 | 0.0019 | 0.048 | 0.027 | — |
| 27 | 0.0021 | 0.01 | 0.24 | 0.010 | 0.011 | 0.062 | 0.0022 | 0.043 | — | 0.0003 |
| 28 | 0.0021 | 0.02 | 0.25 | 0.011 | 0.009 | 0.058 | 0.0021 | 0.044 | — | 0.0007 |
| 29 | 0.0022 | 0.03 | 0.26 | 0.011 | 0.008 | 0.055 | 0.0019 | 0.052 | — | 0.0013 |
| 30 | 0.0017 | 0.02 | 0.24 | 0.012 | 0.009 | 0.060 | 0.0020 | 0.055 | — | 0.0019 |
| 31 | 0.0019 | 0.02 | 0.27 | 0.011 | 0.007 | 0.066 | 0.0019 | 0.038 | 0.009 | 0.0004 |
| 32 | 0.0020 | 0.01 | 0.24 | 0.009 | 0.009 | 0.049 | 0.0022 | 0.028 | 0.014 | 0.0007 |
| 33 | 0.0020 | 0.02 | 0.24 | 0.016 | 0.007 | 0.054 | 0.0019 | 0.044 | 0.010 | — |
| 34 | 0.0019 | 0.01 | 0.22 | 0.008 | 0.006 | 0.055 | 0.0020 | 0.046 | 0.007 | — |
| 35 | 0.0020 | 0.02 | 0.23 | 0.009 | 0.009 | 0.060 | 0.0019 | 0.048 | 0.014 | — |
| 36 | 0.0021 | 0.01 | 0.24 | 0.010 | 0.011 | 0.062 | 0.0022 | 0.043 | — | 0.0004 |

TABLE 23-continued

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 37 | 0.0021 | 0.02 | 0.25 | 0.011 | 0.009 | 0.058 | 0.0021 | 0.044 | — | 0.0006 |
| 38 | 0.0022 | 0.03 | 0.26 | 0.011 | 0.008 | 0.055 | 0.0019 | 0.052 | — | 0.0014 |
| 39 | 0.0017 | 0.02 | 0.24 | 0.012 | 0.009 | 0.060 | 0.0020 | 0.055 | — | 0.0018 |
| 40 | 0.0042* | 0.01 | 0.22 | 0.011 | 0.008 | 0.062 | 0.0017 | 0.044 | — | — |
| 41 | 0.0022 | 0.07* | 0.24 | 0.009 | 0.010 | 0.058 | 0.0021 | 0.048 | — | — |
| 42 | 0.0021 | 0.02 | 0.53* | 0.010 | 0.009 | 0.066 | 0.0022 | 0.065 | — | — |
| 43 | 0.0018 | 0.01 | 0.26 | 0.022* | 0.011 | 0.059 | 0.0018 | 0.055 | — | — |
| 44 | 0.0020 | 0.02 | 0.26 | 0.015 | 0.016* | 0.066 | 0.0017 | 0.038 | — | — |
| 45 | 0.0017 | 0.01 | 0.24 | 0.0122 | 0.009 | 0.011* | 0.0020 | 0.045 | — | 0.0004 |

Asterisk "*" indicates the results out of the scope of the present invention

TABLE 24

| Sample Steel No. | −615[Ti %] + 1160 | −385[Ti %] + 1230 | Temp. for Heating (° C.) | Coiling Temp. (° C.) | Annealing Temp. (° C.) | Alloying Temp. (° C.) | r Value | Appearance | Remarks |
|---|---|---|---|---|---|---|---|---|---|
| 24 | 1133 | 1213 | 1190 | 640 | 850 | 510 | 2.21 | 5 | Example |
| 25 | 1132 | 1212 | 1160 | 640 | 840 | 500 | 2.25 | 5 | Example |
| 26 | 1130 | 1212 | 1190 | 680 | 850 | 500 | 2.20 | 5 | Example |
| 27 | 1134 | 1213 | 1190 | 680 | 850 | 515 | 2.21 | 5 | Example |
| 28 | 1133 | 1213 | 1190 | 640 | 880 | 500 | 2.19 | 5 | Example |
| 29 | 1128 | 1210 | 1200 | 620 | 870 | 500 | 2.07 | 5 | Example |
| 30 | 1126 | 1209 | 1180 | 680 | 860 | 500 | 1.99 | 5 | Example |
| 31 | 1137 | 1215 | 1170 | 690 | 850 | 515 | 1.98 | 5 | Example |
| 32 | 1142 | 1219 | 1160 | 680 | 850 | 500 | 1.99 | 5 | Example |
| 33 | 1133 | 1213 | 1190 | 640 | 860 | 505 | 2.23 | 5 | Example |
| 34 | 1132 | 1212 | 1190 | 620 | 860 | 520 | 2.20 | 5 | Example |
| 35 | 1130 | 1212 | 1190 | 600 | 870 | 505 | 2.25 | 5 | Example |
| 36 | 1134 | 1213 | 1200 | 620 | 880 | 510 | 2.20 | 5 | Example |
| 37 | 1133 | 1213 | 1200 | 640 | 890 | 495 | 2.18 | 5 | Example |
| 38 | 1128 | 1210 | 1200 | 680 | 890 | 490 | 2.15 | 5 | Example |
| 39 | 1126 | 1209 | 1190 | 620 | 880 | 495 | 2.10 | 5 | Example |
| 40 | 1133 | 1213 | 1200 | 600 | 870 | 500 | 1.76 | 5 | Comparative Example |
| 41 | 1130 | 1212 | 1180 | 680 | 850 | 515 | 1.80 | 3 | Comparative Example |
| 42 | 1120 | 1205 | 1190 | 590 | 850 | 510 | 1.75 | 5 | Comparative Example |
| 43 | 1126 | 1209 | 1180 | 620 | 850 | 505 | 1.79 | 4 | Comparative Example |
| 44 | 1137 | 1215 | 1190 | 640 | 860 | 500 | 1.77 | 3 | Comparative Example |
| 45 | 1132 | 1213 | 1190 | 640 | 870 | 505 | 1.65 | 5 | Comparative Example |

TABLE 25

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 46 | 0.0015 | 0.02 | 0.22 | 0.011 | 0.001 | 0.104* | 0.0022 | 0.048 | 0.012 | — |
| 47 | 0.0018 | 0.01 | 0.24 | 0.010 | 0.009 | 0.056 | 0.0042* | 0.032 | — | — |
| 48 | 0.0016 | 0.02 | 0.24 | 0.009 | 0.012 | 0.066 | 0.0023 | 0.018* | — | — |
| 49 | 0.0020 | 0.01 | 0.23 | 0.008 | 0.010 | 0.057 | 0.0021 | 0.152* | — | — |
| 50 | 0.0021 | 0.02 | 0.24 | 0.010 | 0.010 | 0.048 | 0.0020 | 0.043 | 0.004* | — |
| 51 | 0.0019 | 0.01 | 0.22 | 0.007 | 0.007 | 0.050 | 0.0017 | 0.039 | 0.033* | — |
| 52 | 0.0020 | 0.03 | 0.21 | 0.011 | 0.007 | 1.054 | 0.0019 | 0.032 | — | 0.0001* |
| 53 | 0.0016 | 0.01 | 0.36 | 0.014 | 0.009 | 0.053 | 0.0020 | 0.048 | — | 0.0022* |
| 54 | 0.0018 | 0.02 | 0.33 | 0.015 | 0.007 | 0.055 | 0.0021 | 0.045 | — | — |
| 55 | 0.0016 | 0.02 | 0.24 | 0.011 | 0.007 | 0.058 | 0.0020 | 0.099 | — | — |
| 56 | 0.0020 | 0.02 | 0.22 | 0.012 | 0.009 | 0.056 | 0.0019 | 0.101 | — | — |
| 57 | 0.0021 | 0.02 | 0.21 | 0.009 | 0.001 | 0.058 | 0.0021 | 0.145 | — | — |
| 58 | 0.0022 | 0.01 | 0.03 | 0.015 | 0.009 | 0.054 | 0.0023 | 0.089 | — | — |
| 59 | 0.0019 | 0.01 | 0.34 | 0.012 | 0.009 | 0.049 | 0.0019 | 0.105 | — | 0.0004 |

Asterisk "*" indicates the results out of the scope of the present invention

TABLE 26

| Sample Steel No. | −615[Ti %] + 1160 | −385[Ti %] + 1230 | Temp. for Heating (° C.) | Coiling Temp. (° C.) | Annealing Temp. (° C.) | Alloying Temp. (° C.) | r Value | Appearance | Remarks |
|---|---|---|---|---|---|---|---|---|---|
| 46 | 1130 | 1212 | 1200 | 680 | 850 | 505 | 1.76 | 4 | Comparative Example |
| 47 | 1140 | 1218 | 1190 | 640 | 850 | 510 | 1.65 | 5 | Comparative Example |
| 48 | 1149 | 1223 | 1190 | 620 | 850 | 500 | 1.50 | 5 | Comparative Example |
| 49 | 1067 | 1171 | 1170 | 630 | 850 | 500 | 2.40 | 1 | Comparative Example |
| 50 | 1134 | 1213 | 1190 | 650 | 850 | 505 | 2.21 | 3 | Comparative Example |
| 51 | 1136 | 1215 | 1200 | 660 | 850 | 510 | 1.75 | 5 | Comparative Example |
| 52 | 1140 | 1218 | 1200 | 680 | 860 | 510 | 2.10 | 3 | Comparative Example |
| 53 | 1130 | 1212 | 1200 | 640 | 870 | 510 | 1.85 | 5 | Comparative Example |
| 54 | 1132 | 1213 | 1220* | 640 | 880 | 505 | 2.21 | 1 | Comparative Example |
| 55 | 1099 | 1192 | 1190 | 710* | 850 | 495 | 1.76 | 4 | Comparative Example |
| 56 | 1098 | 1191 | 1190 | 480* | 850 | 490 | 1.63 | 4 | Comparative Example |
| 57 | 1071 | 1174 | 1170 | 640 | 930* | 490 | 1.43 | 4 | Comparative Example |
| 58 | 1105 | 1196 | 1190 | 640 | 850 | 440* | 2.40 | 1 | Comparative Example |
| 59 | 1095 | 1190 | 1180 | 620 | 860 | 610* | 2.39 | 2 | Comparative Example |

Asterisk "*" indicates the results out of the scope of the present invention

Example 6 (in the case of Mn: 0.5 to 2.5 wt. %; P: 0.02 to 0.100 wt. % and the soaking temperature: to be controlled)

Example 6-1

Figure 11:
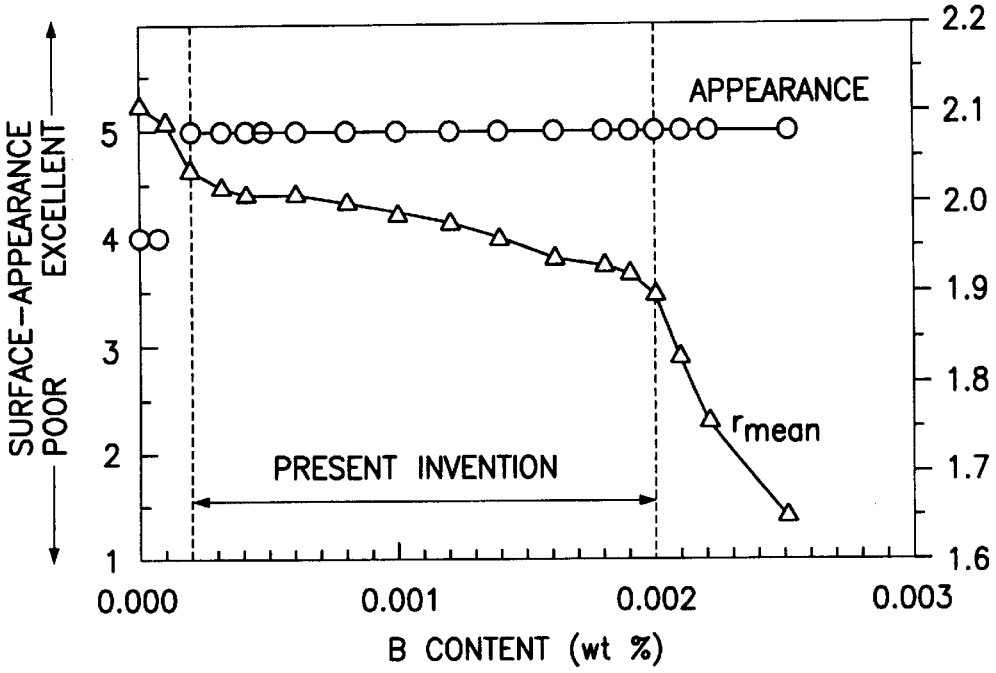
FIG. 11 is a further graph showing the influence of the content of B on the surface appearance and the mean r-value ($r_{mean}$) according to the present invention.

Steel samples having compositions shown in Table 27 were melted to form slabs and then the slabs were soaked at 1180° C. for 50 minutes, followed by being hot-rolled into hot-rolled steel sheets in thickness of 3.6 mm. Then, the hot-rolled steel sheets were coiled at 640° C. The hot-rolled steel sheets were acid-pickled and then cold-rolled into cold-rolled steel sheets in thickness of 0.7 mm. Then, the cold-rolled steel sheets were continuously annealed at 850° C. and then immediately galvanized in a coating weight of 60 g/m$^2$ per surface. Then, the samples were galvannealed at 500° C. and then temper-rolled with a reduction ratio of 0.7% to obtain final products. The surface appearance of each of the obtained products was evaluated in accordance with the foregoing criteria. Test pieces conforming to JIS-#5 were extracted from the products to measure the r-value. The results were shown in FIG. 11. When the samples satisfied the scope of the present invention, steel sheets having excellent surface appearance and deep drawability were obtained.

TABLE 27

| C | Si | Mn | P | S | sol. Al | N | Ti | B |
|---|---|---|---|---|---|---|---|---|
| 0.0018 to 0.0023 | 0.01 to 0.03 | 0.85 to 0.91 | 0.041 to 0.046 | 0.007 to 0.009 | 0.049 to 0.055 | 0.0017 to 0.0021 | 0.041 to 0.047 | 0 to 0.0025 (wt %) |

Example 6-2

Figure 12:
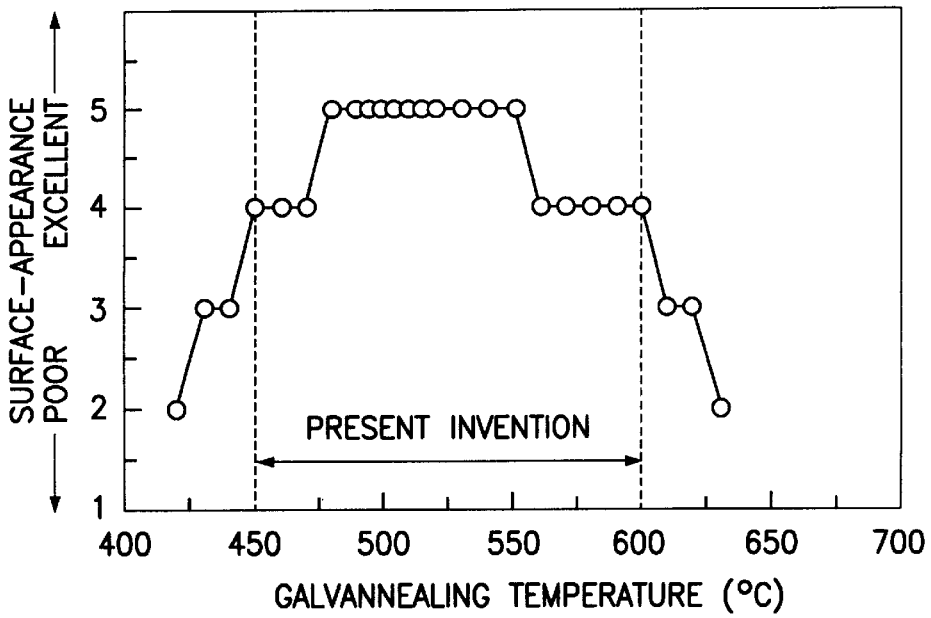
FIG. 12 is another graph showing the relationship between galvannealing temperature and the surface appearance according to the present invention.

Steel samples having compositions shown in Table 28 were melted to form slabs and then the slabs were soaked at 1190° C. for 40 minutes, followed by being hot-rolled into hot-rolled steel sheets in thickness of 3.2 mm. Then, the hot-rolled steel sheets were coiled at 680° C. The hot-rolled steel sheets were acid-washed and then cold-rolled into cold-rolled steel sheets in thickness of 0.8 mm. Then, the cold-rolled steel sheets were continuously annealed at 840° C. and then immediately galvanized in a coating weight of 60 g/m$^2$ per surface. Then, the galvanized steel sheets were galvannealed at 420 to 630° C. and then temper-rolled with a reduction ratio of 0.7% to form final products. The surface appearance of each of the obtained products was evaluated in accordance with the foregoing criteria. Results were shown in FIG. 12. When the samples satisfied the scope of the present invention, steel sheets having excellent surface appearance were obtained.

TABLE 28

| C | Si | Mn | P | S | sol. Al | N | Ti | −400[% Ti] + [% P] + 1250 |
|---|---|---|---|---|---|---|---|---|
| 0.0019 | 0.02 | 0.77 | 0.045 | 0.009 | 0.056 | 0.0022 | 0.049 | 1212 |

(wt %)

Example 6-3

Steel samples having compositions shown in Tables 29, 31 and 33 were melted to form slabs and the slabs were heated at a predetermined temperature, followed by being hot-rolled into hot-rolled steel sheets in thickness of 3.2 m. The hot-rolled steel sheets were acid-pickled and then cold-rolled into cold-rolled steel sheets in thickness of 0.8 mm. Then, the cold-rolled steel sheets were continuously annealed at 780 to 930° C. and then immediately galvanized in a coating weight of 60 g/m$^2$ per surface. Then, the galvanized steel sheets were galvannealed at 440 to 610° C. Then, the galvanealed steel sheets were temper-rolled at reduction ratios of 0.5 to 1.0% to form final products. The manufacturing conditions were shown in Tables 30, 32 and 34. Some of the products were applied with Fe—Zn alloy electroplating on the Zn-coating layer. Test pieces conforming to JIS-#5 were extracted from the obtained products to perform tensile tests and the surface appearance of each sample was evaluated in accordance with the foregoing criteria. The results were collectively shown in Tables 30, 32 and 34. As can be understood from the results, the present invention (Nos. 1 to 39) enabled steel sheets having excellent surface appearance and formability to be manufactured. Since Comparative Examples 40, 43 and 45 contained C, Mn and P in large quantities, the r value of the structure deteriorated. Since Comparative Examples 42 and 44 contained Mn and P in small quantities, the strength deteriorated. Since Comparative Example 41 contained Si in a large quantity, surface appearance deteriorated. Since Comparative Example 46 contained Al in a quantity out of the scope of the present invention, the r-value deteriorated. Since Comparative Example 47 contained N in a large quantity, the r-value deteriorated. Since Comparative Example 48 contained Ti in a small quantity, the r-value deteriorated. Since Comparative Example 49 contained Ti in a large quantity, surface appearance deteriorated. Since Comparative Examples 50 and 52 contained Nb and B in small quantities, surface appearance deteriorated. Since Comparative Examples 51 and 53 contained Nb and B in large quantities, the r-value deteriorated. Since Comparative Example 54 was heated at excessive high temperature, surface appearance deteriorated. Since Comparative Examples 55 and 56 was coiled at temperature out of the scope of the present invention, the r-value deteriorated. Since Comparative Example 57 was annealed at a level of more than the Ar3 transformation temperature, r-value deteriorated. Since Comparative Examples 58 and 59 were alloyed at a temperature out of the scope of the present invention, surface appearance deteriorated.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

TABLE 29

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 1 | 0.1012 | 0.01 | 0.71 | 0.044 | 0.006 | 0.054 | 0.0021 | 0.041 | — | — |
| 2 | 1.0019 | 0.02 | 0.65 | 0.039 | 0.007 | 0.060 | 0.0022 | 0.042 | — | — |
| 3 | 0.0026 | 0.01 | 0.77 | 0.042 | 0.007 | 0.060 | 0.0021 | 0.043 | — | — |
| 4 | 0.0038 | 0.02 | 0.62 | 0.041 | 0.008 | 0.056 | 0.0022 | 0.044 | — | — |
| 5 | 0.0021 | 0.04 | 0.64 | 0.043 | 0.009 | 0.066 | 0.0021 | 0.045 | — | — |
| 6 | 0.0019 | 0.02 | 0.82 | 0.044 | 0.010 | 0.058 | 0.0022 | 0.041 | — | — |
| 7 | 0.0019 | 0.02 | 1.14 | 0.032 | 0.008 | 0.059 | 0.0021 | 0.044 | — | — |
| 8 | 0.0018 | 0.02 | 1.56 | 0.034 | 0.008 | 0.066 | 0.0019 | 0.049 | — | — |
| 9 | 0.0017 | 0.02 | 1.89 | 0.029 | 0.009 | 0.054 | 0.0020 | 0.029 | — | — |
| 10 | 0.0020 | 0.02 | 2.01 | 0.042 | 0.003 | 0.055 | 0.0021 | 0.038 | — | — |
| 11 | 0.0019 | 0.01 | 2.47 | 0.041 | 0.008 | 0.062 | 0.0023 | 0.048 | — | — |
| 12 | 0.0020 | 0.02 | 0.74 | 0.066 | 0.009 | 0.055 | 0.0022 | 0.047 | — | — |
| 13 | 0.0022 | 0.01 | 0.65 | 0.094 | 0.007 | 0.060 | 0.0019 | 0.041 | — | — |
| 14 | 0.0021 | 0.02 | 0.76 | 0.038 | 0.012 | 0.061 | 0.0020 | 0.068 | — | — |
| 15 | 0.0023 | 0.01 | 0.84 | 0.044 | 0.007 | 0.089 | 0.0019 | 0.065 | — | — |
| 16 | 0.0021 | 0.02 | 0.80 | 0.038 | 0.009 | 0.055 | 0.0021 | 0.088 | — | — |
| 17 | 0.0022 | 0.01 | 0.77 | 0.043 | 0.010 | 0.056 | 0.0022 | 0.101 | — | — |
| 18 | 0.0021 | 0.02 | 0.66 | 0.048 | 0.011 | 0.055 | 0.0019 | 0.147 | — | — |
| 19 | 0.1022 | 0.02 | 0.70 | 0.045 | 0.007 | 0.058 | 0.0022 | 0.064 | — | — |
| 20 | 0.0023 | 0.01 | 0.57 | 0.033 | 0.006 | 0.066 | 0.0021 | 0.047 | — | — |
| 21 | 0.0022 | 0.02 | 0.66 | 0.029 | 0.011 | 0.058 | 0.0022 | 0.059 | — | — |
| 22 | 0.0022 | 0.01 | 0.89 | 0.044 | 0.008 | 0.065 | 0.0019 | 0.047 | — | — |
| 23 | 0.0021 | 0.01 | 0.77 | 0.050 | 0.007 | 0.048 | 0.0022 | 0.060 | — | — |

TABLE 30

| Sample Steel No. | −400 ([Ti %] + [P%]) + 1250 | Temp. for Heating (° C.) | Coiling Temp. (° C.) | Annealing Temp. (° C.) | Alloying Temp. (° C.) | TS (MPa) | r Value | Appearance | Remarks |
|---|---|---|---|---|---|---|---|---|---|
| 1 | 1216 | 1190 | 680 | 850 | 505 | 343 | 2.10 | 5 | Example |
| 2 | 1218 | 1180 | 680 | 840 | 510 | 345 | 2.05 | 5 | Example |
| 3 | 1216 | 1120 | 670 | 880 | 500 | 347 | 2.02 | 5 | Example |
| 4 | 1216 | 1190 | 660 | 850 | 495 | 344 | 1.99 | 5 | Example |
| 5 | 1215 | 1200 | 680 | 860 | 495 | 345 | 2.08 | 5 | Example |
| 6 | 1216 | 1200 | 640 | 840 | 505 | 372 | 2.02 | 5 | Example |
| 7 | 1220 | 1190 | 620 | 850 | 495 | 388 | 2.00 | 5 | Example |
| 8 | 1217 | 1190 | 600 | 850 | 500 | 404 | 1.98 | 5 | Example |
| 9 | 1227 | 1120 | 580 | 850 | 500 | 434 | 1.96 | 5 | Example |
| 10 | 1218 | 1150 | 680 | 850 | 500 | 440 | 1.93 | 5 | Example |
| 11 | 1214 | 1170 | 670 | 860 | 495 | 447 | 1.91 | 5 | Example |
| 12 | 1205 | 1200 | 640 | 870 | 590 | 348 | 2.07 | 5 | Example |
| 13 | 1196 | 1190 | 640 | 880 | 495 | 404 | 2.01 | 5 | Example |
| 14 | 1208 | 1190 | 650 | 850 | 500 | 348 | 2.23 | 5 | Example |
| 15 | 1206 | 1180 | 650 | 830 | 505 | 349 | 2.19 | 5 | Example |
| 16 | 1200 | 1180 | 660 | 830 | 515 | 344 | 2.24 | 5 | Example |
| 17 | 1192 | 1180 | 680 | 800 | 460 | 346 | 2.27 | 4 | Example |
| 18 | 1172 | 1170 | 510 | 810 | 495 | 349 | 2.29 | 4 | Example |
| 19 | 1206 | 1190 | 690 | 780 | 500 | 355 | 2.03 | 5 | Example |
| 20 | 1220 | 1200 | 680 | 810 | 505 | 340 | 2.04 | 5 | Example |
| 21 | 1215 | 1200 | 640 | 850 | 510 | 341 | 2.09 | 5 | Example |
| 22 | 1214 | 1190 | 630 | 850 | 515 | 347 | 2.03 | 5 | Example |
| 23 | 1206 | 1190 | 620 | 850 | 510 | 343 | 2.04 | 5 | Example |

TABLE 31

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 24 | 0.0020 | 0.02 | 0.66 | 0.037 | 0.007 | 0.054 | 0.0019 | 0.041 | 0.011 | — |
| 25 | 0.0019 | 0.01 | 1.25 | 0.045 | 0.006 | 0.055 | 0.0020 | 0.046 | 0.006 | — |
| 26 | 0.0020 | 0.02 | 0.89 | 0.051 | 0.009 | 0.060 | 0.0019 | 0.048 | 0.027 | — |
| 27 | 0.0021 | 0.01 | 1.44 | 0.049 | 0.011 | 0.062 | 0.0022 | 0.043 | — | 0.0003 |
| 28 | 0.0021 | 0.02 | 0.56 | 0.044 | 0.009 | 0.058 | 0.0021 | 0.044 | — | 0.0007 |
| 29 | 0.0022 | 0.03 | 0.87 | 0.048 | 0.008 | 0.055 | 0.0019 | 0.052 | — | 0.0013 |
| 30 | 0.0017 | 0.02 | 1.05 | 0.031 | 0.009 | 0.060 | 0.0020 | 0.055 | — | 0.0019 |
| 31 | 0.0019 | 0.02 | 1.02 | 0.039 | 0.007 | 0.066 | 0.0019 | 0.038 | 0.009 | 0.0004 |
| 32 | 0.0020 | 0.01 | 1.69 | 0.044 | 0.009 | 0.049 | 0.0022 | 0.029 | 0.014 | 2.0007 |
| 33 | 0.0020 | 0.02 | 2.00 | 0.061 | 0.007 | 0.054 | 0.0019 | 0.044 | 0.010 | — |
| 34 | 0.0019 | 0.01 | 1.24 | 0.067 | 0.006 | 0.055 | 0.0020 | 0.046 | 0.007 | — |
| 35 | 0.0020 | 0.32 | 1.00 | 0.041 | 0.009 | 0.060 | 0.0019 | 0.048 | 0.014 | — |
| 36 | 0.0021 | 0.01 | 0.99 | 0.055 | 0.011 | 0.062 | 0.0020 | 0.043 | — | 0.0004 |
| 37 | 0.0021 | 0.02 | 1.21 | 0.066 | 0.009 | 0.058 | 0.0021 | 0.044 | — | 0.0006 |
| 38 | 0.0022 | 0.03 | 0.77 | 0.074 | 0.008 | 0.055 | 0.0019 | 0.052 | — | 0.0014 |
| 39 | 0.0017 | 0.02 | 0.89 | 0.049 | 0.009 | 0.060 | 0.0020 | 0.255 | — | 0.0018 |
| 40 | 0.0042* | 0.01 | 1.22 | 0.041 | 0.008 | 0.062 | 0.0017 | 0.044 | — | — |
| 41 | 0.0022 | 0.07* | 0.78* | 0.055 | 0.010 | 0.058 | 0.0021 | 0.048 | — | — |
| 42 | 0.0021 | 0.02 | 0.43* | 0.056 | 0.009 | 0.066 | 0.0022 | 0.065 | — | — |
| 43 | 0.0018 | 0.01 | 2.54* | 0.048 | 0.011 | 0.059 | 0.0018 | 0.055 | — | — |
| 44 | 0.0020 | 0.02 | 0.90 | 0.015* | 0.010 | 0.066 | 0.0017 | 0.038 | — | — |
| 45 | 0.0017 | 0.01 | 0.94 | 0.104* | 0.009 | 0.056 | 0.0020 | 0.045 | — | 0.0004 |

Asterisk "*" indicates the results out of the scope of the present invention

TABLE 32

| Sample Steel No. | −400 ([Ti %] + [P %]) + 1250 | Temp. for Heating (° C.) | Coiling Temp. (° C.) | Annealing Temp. (° C.) | Alloying Temp. (° C.) | TS (MPa) | r Value | Appearance | Remarks |
|---|---|---|---|---|---|---|---|---|---|
| 24 | 1218 | 1190 | 640 | 850 | 510 | 350 | 2.02 | 5 | Example |
| 25 | 1214 | 1180 | 640 | 840 | 500 | 391 | 2.06 | 5 | Example |
| 26 | 1210 | 1190 | 680 | 850 | 500 | 382 | 2.01 | 5 | Example |

TABLE 32-continued

| Sample Steel No. | −400 ([Ti %] + [P %]) + 1250 | Temp. for Heating (° C.) | Coiling Temp. (° C.) | Annealing Temp. (° C.) | Alloying Temp. (° C.) | TS (MPa) | r Value | Appearance | Remarks |
|---|---|---|---|---|---|---|---|---|---|
| 27 | 1213 | 1190 | 680 | 850 | 515 | 399 | 2.02 | 5 | Example |
| 28 | 1215 | 1190 | 640 | 880 | 510 | 405 | 2.00 | 5 | Example |
| 29 | 1210 | 1200 | 620 | 870 | 500 | 407 | 1.98 | 5 | Example |
| 30 | 1213 | 1180 | 680 | 860 | 500 | 407 | 1.93 | 5 | Example |
| 31 | 1219 | 1180 | 690 | 850 | 515 | 410 | 1.97 | 5 | Example |
| 32 | 1221 | 1190 | 680 | 850 | 500 | 436 | 1.92 | 5 | Example |
| 33 | 1208 | 1190 | 640 | 860 | 505 | 444 | 1.91 | 5 | Example |
| 34 | 1205 | 1190 | 620 | 860 | 520 | 391 | 2.05 | 5 | Example |
| 35 | 1212 | 1190 | 600 | 870 | 505 | 393 | 2.01 | 5 | Example |
| 36 | 1211 | 1200 | 620 | 880 | 510 | 376 | 1.99 | 5 | Example |
| 37 | 1206 | 1200 | 640 | 870 | 495 | 391 | 1.93 | 5 | Example |
| 38 | 1200 | 1190 | 680 | 890 | 490 | 363 | 2.01 | 5 | Example |
| 39 | 1208 | 1190 | 620 | 880 | 495 | 378 | 1.99 | 5 | Example |
| 40 | 1216 | 1200 | 600 | 870 | 500 | 385 | 1.87 | 5 | Comparative Example |
| 41 | 1209 | 1180 | 680 | 850 | 515 | 346 | 2.11 | 3 | Comparative Example |
| 42 | 1202 | 1190 | 590 | 850 | 510 | 325 | 2.23 | 5 | Comparative Example |
| 43 | 1209 | 1180 | 620 | 850 | 525 | 405 | 1.65 | 4 | Comparative Example |
| 44 | 1229 | 1190 | 640 | 860 | 500 | 320 | 2.25 | 3 | Comparative Example |
| 45 | 1190 | 1180 | 640 | 870 | 505 | 440 | 1.72 | 5 | Comparative Example |

TABLE 33

| Sample Steel | CHEMICAL COMPOSITION (wt %) | | | | | | | | | |
|---|---|---|---|---|---|---|---|---|---|---|
| No. | C | Si | Mn | P | S | sol. Al | N | Ti | Nb | B |
| 46 | 0.0015 | 0.02 | 1.05 | 0.041 | 0.007 | 0.104* | 0.0022 | 0.048 | 0.012 | — |
| 47 | 0.0018 | 0.01 | 1.21 | 0.039 | 0.009 | 0.056 | 0.0042* | 0.022 | — | — |
| 48 | 0.0016 | 0.02 | 0.89 | 0.056 | 0.012 | 0.066 | 0.0023 | 0.018* | — | — |
| 49 | 0.0020 | 0.01 | 0.98 | 0.066 | 0.010 | 0.057 | 0.0021 | 0.152* | — | — |
| 50 | 0.0021 | 0.02 | 1.44 | 0.048 | 0.010 | 0.048 | 0.0020 | 0.043 | 0.004* | — |
| 51 | 0.0019 | 0.01 | 1.25 | 0.050 | 0.007 | 0.050 | 0.0017 | 0.039 | 0.033* | — |
| 52 | 0.0020 | 0.03 | 1.90 | 0.061 | 0.007 | 0.054 | 0.0019 | 0.144 | — | 0.0001* |
| 53 | 0.0016 | 0.01 | 2.01 | 0.044 | 0.009 | 0.053 | 0.0020 | 0.048 | — | 0.0022* |
| 54 | 0.0018 | 0.02 | 0.78 | 0.048 | 0.007 | 0.055 | 0.0021 | 0.045 | — | — |
| 55 | 0.0016 | 0.02 | 0.80 | 0.054 | 0.007 | 0.058 | 0.0020 | 0.099 | — | — |
| 56 | 0.0020 | 0.02 | 0.77 | 0.061 | 0.009 | 0.056 | 0.0019 | 0.101 | — | — |
| 57 | 0.0021 | 0.02 | 0.65 | 0.070 | 0.001 | 0.058 | 0.0021 | 0.145 | — | — |
| 58 | 0.0022 | 0.01 | 0.99 | 0.045 | 0.009 | 0.054 | 0.0023 | 0.089 | — | — |
| 59 | 0.0019 | 0.01 | 1.01 | 0.052 | 0.009 | 0.049 | 0.0019 | 0.105 | — | 0.0004 |

Asterisk "*" indicates the results out of the scope of the present invention

TABLE 34

| Sample Steel No. | −400 ([Ti %] + [P %]) + 1250 | Temp. for Heating (° C.) | Coiling Temp. (° C.) | Annealing Temp. (° C.) | Alloying Temp. (° C.) | TS (MPa) | r Value | Appearance | Remarks |
|---|---|---|---|---|---|---|---|---|---|
| 46 | 1214 | 1200 | 680 | 850 | 505 | 380 | 1.85 | 4 | Comparative Example |
| 47 | 1222 | 1190 | 640 | 850 | 510 | 392 | 1.77 | 5 | Comparative Example |
| 48 | 1220 | 1190 | 620 | 850 | 500 | 346 | 1.79 | 5 | Comparative Example |
| 49 | 1163 | 1150 | 630 | 850 | 500 | 344 | 2.21 | 1 | Comparative Example |

TABLE 34-continued

| Sample Steel No. | −400 ([Ti %] + [P %]) + 1250 | Temp. for Heating (° C.) | Coiling Temp. (° C.) | Annealing Temp. (° C.) | Alloying Temp. (° C.) | TS (MPa) | r Value | Appearance | Remarks |
|---|---|---|---|---|---|---|---|---|---|
| 50 | 1174 | 1170 | 650 | 850 | 505 | 388 | 2.13 | 3 | Comparative Example |
| 51 | 1214 | 1200 | 660 | 850 | 510 | 376 | 1.83 | 5 | Comparative Example |
| 52 | 1618 | 1150 | 680 | 860 | 510 | 444 | 2.11 | 3 | Comparative Example |
| 53 | 1213 | 1200 | 640 | 870 | 510 | 439 | 1.76 | 5 | Comparative Example |
| 54 | 1213 | 1240* | 640 | 880 | 505 | 341 | 2.05 | 1 | Comparative Example |
| 55 | 1189 | 1180 | 710* | 850 | 495 | 343 | 1.77 | 4 | Comparative Example |
| 56 | 1185 | 1180 | 480* | 850 | 490 | 349 | 1.65 | 4 | Comparative Example |
| 57 | 1164 | 1150 | 640 | 930* | 490 | 347 | 1.53 | 4 | Comparative Example |
| 58 | 1196 | 1190 | 620 | 850 | 440* | 345 | 2.05 | 1 | Comparative Example |
| 59 | 1187 | 1180 | 620 | 860 | 610* | 373 | 1.90 | 2 | Comparative Example |

Symbol * indicates the result out of the scope of the present invention.

What is claimed is:

1. A method for producing a galvannealed steel sheet having an excellent surface appearance, comprising:

(a) preparing a slab consisting essentially of C in an amount of 0.004 wt. % or less, N in an amount of 0.004 wt. % or less, Ti in an amount of 0.041 to 0.15 wt. %, Si in an amount of 0.05 wt. % or less, Mn in an amount of less than 0.5 wt. %, P in an amount of less than 0.02 wt. %, S in an amount of 0.015 wt. % or less, sol. Al in an amount of 0.02 to 0.1 wt. % optionally Nb in an amount of 0.001 to 0.02 wt. %, optionally B in an amount of 0.0001 to 0.002 wt. %, and the balance being Fe;

(b) soaking the slab from step (a) at a temperature (T° C.) defined by the following equation for at least 30 minutes:

$$-615[\%Ti]+1160 \leqq T \leqq -385[\%Ti]+1230;$$

(c) hot-rolling the soaked slab from step (b) to produce a hot-rolled steel sheet and then coiling the hot-rolled steel sheet at a temperature of 500 to 700° C.;

(d) cold-rolling the coiled hot-rolled steel sheet from step (c) at a reduction ratio of 60% or more to produce a cold-rolled steel sheet;

(e) annealing the cold-rolled steel sheet from step (d) at a temperature of from recrystallization temperature to $Ac_3$ transformation temperature;

(f) galvanizing the annealed cold-rolled steel sheet from step (e); and (g) galvannealing the galvanized cold-rolled steel sheet from step (f) at a temperature of 450 to 600° C.

2. The method of claim 1, wherein said Nb is in an amount of 0.001 to 0.02 wt. %.

3. The method of claim 1, wherein said B is in an amount of 0.0001 to 0.002 wt. %.

4. The method of claim 1 further comprising the step of forming a Fe—Zn coating layer containing Fe in an amount of 50 wt. % or more, on a surface of the galvannealed steel sheet.

5. The method of claim 1, wherein said temperature (T) in the step (b) for soaking the slab is 1190° C. or less.

6. The method of claim 5, wherein said temperature (T) in the step (b) for soaking the slab is 1180° C. or less.

* * * * *